US005736288A

United States Patent [19]

Kasuya et al.

[11] Patent Number: 5,736,288

[45] Date of Patent: Apr. 7, 1998

[54] TONER FOR DEVELOPING ELECTROSTATIC IMAGES, PROCESS CARTRIDGE, AND IMAGE FORMING METHOD

[75] Inventors: Takashige Kasuya, Soka; Hiroyuki Suematsu; Koichi Tomiyama, both of Yokohama; Hiroshi Yusa, Machida; Takakuni Kobori, Kawasaki; Masaichiro Katada, Yokohama, all of Japan

[73] Assignee: Canon Kabushiki Kaisha, Tokyo, Japan

[21] Appl. No.: 440,935

[22] Filed: May 15, 1995

[30] Foreign Application Priority Data

| | | | |
|---|---|---|---|
| May 13, 1994 | [JP] | Japan | 6-123302 |
| Jul. 29, 1994 | [JP] | Japan | 6-196211 |
| Jan. 20, 1995 | [JP] | Japan | 7-007424 |
| Jan. 27, 1995 | [JP] | Japan | 7-011697 |

[51] Int. Cl.[6] ..... G03G 9/087

[52] U.S. Cl. ..... 430/106.6; 430/110; 430/109; 430/124; 430/126

[58] Field of Search ..... 430/109, 110, 430/124, 126, 120, 106.6

[56] References Cited

U.S. PATENT DOCUMENTS

| | | | |
|---|---|---|---|
| 2,297,691 | 10/1942 | Carlson . | |
| 3,909,258 | 9/1975 | Kotz . | |
| 3,941,898 | 3/1976 | Sadamatsu et al. | 427/18 |
| 5,135,833 | 8/1992 | Matsunaga et al. | 430/110 |
| 5,300,386 | 4/1994 | Kanbayashi et al. | 430/99 |
| 5,338,638 | 8/1994 | Tsuchiya et al. | 430/106 |
| 5,354,640 | 10/1994 | Kanbayashi et al. | 430/110 |
| 5,364,721 | 11/1994 | Asada et al. | 430/109 |
| 5,411,830 | 5/1995 | Matsunaga | 430/106.6 |
| 5,415,965 | 5/1995 | Tsuda et al. | 430/109 |
| 5,439,770 | 8/1995 | Taya et al. | 430/110 |
| 5,447,813 | 9/1995 | Hagiwara et al. | 430/106.6 |
| 5,468,585 | 11/1995 | Matsumoto et al. | 430/109 |

FOREIGN PATENT DOCUMENTS

| | | |
|---|---|---|
| 2-168264 | 6/1990 | European Pat. Off. . |
| 0488414 | 6/1992 | European Pat. Off. . |
| 0592018 | 4/1994 | European Pat. Off. . |
| 42-23910 | 11/1967 | Japan . |
| 43-24748 | 10/1968 | Japan . |
| 51-23354 | 7/1976 | Japan . |
| 55-18656 | 2/1980 | Japan . |
| 55-6805 | 2/1980 | Japan . |
| 56-116043 | 9/1981 | Japan . |
| 57-178249 | 11/1982 | Japan . |
| 57-178250 | 11/1982 | Japan . |
| 57-208559 | 12/1982 | Japan . |
| 61-34070 | 2/1986 | Japan . |
| 61-110155 | 5/1986 | Japan . |
| 61-110156 | 5/1986 | Japan . |
| 62-9256 | 1/1987 | Japan . |
| 62-9356 | 1/1987 | Japan . |
| 62-278131 | 12/1987 | Japan . |

(List continued on next page.)

OTHER PUBLICATIONS

Patent Abstracts of Japan, vol. 11, No. 178 (P-584) 1987.

*Primary Examiner*—Christopher D. Rodee

*Attorney, Agent, or Firm*—Fitzpatrick, Cella, Harper & Scinto

[57] ABSTRACT

A toner is comprised of a composition containing at least a polymer component and a charge control agent. The polymer component contains substantially no tetrahydrofuran (THF)-insoluble matter. The polymer component THF-soluble has a major peak and a minor peak in the specific molecular weight regions in gel permeation chromatography (GPC). The low molecular weight component and high molecular weight component of the polymer component, each of which shows the specific molecular weight region in GPC, have the specific acid values, respectively. The difference between the acid values is in the specific range.

50 Claims, 3 Drawing Sheets

FOREIGN PATENT DOCUMENTS

| | | |
|---|---|---|
| 62-279352 | 12/1987 | Japan . |
| 63-214760 | 9/1988 | Japan . |
| 63-217362 | 9/1988 | Japan . |
| 63-217363 | 9/1988 | Japan . |
| 63-217364 | 9/1988 | Japan . |
| 1-15063 | 3/1989 | Japan . |
| 2-235069 | 9/1990 | Japan . |
| 3-9045 | 2/1991 | Japan . |
| 4-362954 | 12/1992 | Japan . |
| 5-72801 | 3/1993 | Japan . |
| 5-173363 | 7/1993 | Japan . |
| 5-173366 | 7/1993 | Japan . |
| 5-213620 | 8/1993 | Japan . |
| 5-241371 | 9/1993 | Japan . |

TONER FOR DEVELOPING ELECTROSTATIC IMAGES, PROCESS CARTRIDGE, AND IMAGE FORMING METHOD

BACKGROUND OF THE INVENTION

1. Field of the Invention

This invention relates to a toner for developing electrostatic latent images, used in an image forming process such as electrophotography or electrostatic printing, a process cartridge having such a toner and an image forming method making use of the toner.

2. Related Background Art

A number of methods as disclosed in U.S. Pat. No. 2,297,691, Japanese Patent Publications No. 42-23910 and No. 43-24748 and so forth are hitherto known as electrophotography. In general, copies or prints are obtained by forming an electrostatic latent image on a photosensitive member by utilizing a photoconductive material, subsequently developing the latent image by the use of a toner, and transferring the toner image to a transfer medium such as paper if necessary, followed by fixing by the action of heat, pressure, heat-and-pressure, or solvent vapor. The toner not transferred to and remaining on the photosensitive member is cleaned by various means, and then the above process is repeated.

In recent years, such copying apparatus are severely sought to be made small-sized, lightweight and highly reliable. As a result, a high performance has become required for toners. For example, various methods or devices have been developed in relation to the step of fixing a toner image to a sheet such as paper. A method most commonly available at present is the pressure heat system using a heat roller. The pressure heat system using a heat roller is a method of carrying out fixing by causing a toner image surface of an image-receiving sheet to pass the surface of a heat roller whose surface is formed of a material having releasability from toner while the former is brought into contact with the latter under application of a pressure. Since in this method the surface of the heat roller comes into contact with the toner image of the image-receiving sheet under application of a pressure, a very good thermal efficiency can be achieved when the toner image is fixed onto the image-receiving sheet, so that the fixing can be carried out rapidly. Thus, this method is very effective in high-speed electrophotographic copying machines.

The heat-roll fixing having been hitherto widely used, however, has the following problems:

(1) A time during which an image-forming operation is prohibited, i.e., what is called a waiting time, is required until the heat roller reaches a given temperature.

(2) The heat roller must be maintained at an optimum temperature in order to prevent poor fixing from being caused by the variations of the heat-roller temperature that may occur when the recording medium is passed or because of other external factors, and also to prevent the phenomenon of offset of toner to the heat roller. This requires that the heat capacity of the heat roller or a heater element be large, which requires substantial electric power and also causes in-machine temperature rise in the image forming apparatus.

(3) When the recording medium passes over the heat roller, the recording medium and the toner on the recording medium are slowly cooled because of a low temperature of the heat roller, resulting in high adhesion of the toner.

Thus, such a state of toner and the curvature of the roller together often causes offset, or paper jam due to the winding of the recording medium around the roller.

However, in addition to the above factors of fixing means, the properties of toner are very important in order to realize a fixing method that may require only a short waiting time and a low consumption of electric power while achieving excellent performance of fixing toner images to a recording medium and excellent anti-offset properties.

For the purpose of causing no toner to adhere to the surface of a fixing roller, it has been hitherto put into practice to add a wax such as low-molecular weight polyethylene or low-molecular weight polypropylene that may well melt at the time of heating, in order to increase the release properties of the toner. This is effective for preventing offset, but on the other hand results in an increase in agglomerating properties of toner to tend to make charging performance unstable and tends to cause a lowering of running performance. Accordingly, as other methods, it has been variously attempted to improve binder resins.

For example, a method is known in which the glass transition temperature (Tg) and molecular weight of a binder resin in toner are increased to improve the melt viscoelasticity of the toner. Such a method, however, raises the problem that the improvement in anti-offset properties may result in a lowering of fixing performance to cause a lowering of the fixing performance in low-temperature fixing, i.e., low-temperature fixing performance, which is required for the achievement of high-speed development and energy saving.

In general, in order to improve the low-temperature fixing performance of toners, it is necessary to decrease the viscosity of toner at the time of its melting, and increase the area in contact with a fixing substrate. For this reason, it is required to lower the Tg and molecular weight of binder resins used.

The low-temperature fixing performance and the anti-offset properties conflict with each other in some phase, and hence it is very difficult to provide toners satisfying these performances at the same time.

To solve this problem, for example, a toner comprising a vinyl polymer cross-linked to an appropriate degree by adding a cross-linking agent and a molecular weight modifier is proposed in Japanese Patent Publication No. 51-23354. In Japanese Patent Publication No. 55-6805, a toner is proposed having as a constituent an $\alpha,\beta$-unsaturated ethylene monomer and made to have a broad molecular weight distribution so that the ratio of weight average molecular weight to number average molecular weight (Mw/Mn) is 3.5 to 4.0. A toner having a blend type resin of a vinyl polymer whose Tg, molecular weight and gel content are specified is also proposed.

The toners according to these proposals certainly have a broader fixing temperature range between the lowest fixing temperature (the lowest temperature at which the fixing is possible) and the offset temperature (the temperature at which the offset begins to occur). There, however, has been the problem that it is difficult to make their fixing temperature sufficiently low when a satisfactory anti-offset performance is imparted to the toner and on the other hand the anti-offset performance becomes low when importance is attached to the low-temperature fixing performance.

Japanese Patent Application Laid-open No. 57-208559 discloses a toner comprising, in place of such vinyl type resins, a polyester resin which is considered substantially superior to the vinyl type resins in view of low-temperature fixing performance, the polyester resin being cross-linked and also being incorporated with an anti-offset agent. This toner is superior in both the low-temperature fixing performance and anti-offset properties, but has a problem in respect of the productivity (grindability) of toner.

Japanese Patent Application Laid-open No. 56-116043 also discloses a toner making use of a resin made polymeric by polymerizing vinyl monomers in the presence of a reactive polyester resin and inserting cross-linking reaction, addition reaction or grafting reaction in the course of the polymerization. This toner has achieved an improvement in respect of grindability, but, in respect of low-temperature fixing performance and anti-offset properties, it is difficult to make full use of the function of each resin.

Japanese Patent Publication No. 1-15063 discloses a toner making use of a resin composition prepared by simply blending a polyester resin with two kinds of vinyl resins having different gel contents (with a degree of gelation of 80% or more and a degree of gelation of less than 10%). This toner is satisfactory in respect of low-temperature fixing performance, but has room for an improvement in respect of anti-offset properties and grindability. If the proportion of the vinyl resin having a gel content of 80% or more is increased for the purpose of improving the anti-offset properties, the anti-offset properties may be improved but on the other hand the low-temperature fixing performance tends to lower. Merely incorporating the vinyl resin having a gel content of less than 10% makes it difficult to satisfy a sufficient grindability when toners are produced.

Meanwhile, with regard to physical properties required in the toners as shown above, it is proposed that a binder resin is cross-linked by allowing a polymer having a carboxylic acid group to react with a metal compound (Japanese Patent Applications Laid-open No. 57-178249 and No. 57-178250), or that a binder having as essential constituents a vinyl resin monomer and a special monoester compound is allowed to react with a polyvalent metal compound to carry out cross-linking through a metal (Japanese Patent Applications Laid-open No. 61-110155 and No. 61-110156).

Japanese Patent Applications Laid-open No. 63-214760, No. 63-217362, No. 63-217363 and No. 63-217364 disclose that a binder resin has a molecular weight distribution separated into two groups, a low-molecular weight region and a high-molecular weight region, and carboxylic acid groups incorporated into the low-molecular weight region side are allowed to react with polyvalent metal ions to carry out cross-linking (a dispersion of a metal compound is added in a solution obtained by solution polymerization, followed by heating to carry out the reaction). In any methods disclosed therein, it is difficult to react well the binder with the metal compound or to disperse well the metal compound in the binder resin. Thus, it is sought to more improve the properties required in toners, in particular, fixing performance and anti-offset properties. Moreover, since the metal compound must be mixed in the binder resin in a large quantity, the metal compound mixed may act as a catalyst on the binder resin under some conditions, and the binder resin tends to undergo gelation. As a result, it is difficult to mix the metal compound and determine production conditions for obtaining the desired toners. Even if the production conditions could be determined, there is the problem of a difficulty in reproducibility.

Adjustment of acid values of these toners leaves room for further improvement in charging performance (charging rise) of toner, environmental properties (high-humidity storage stability) and image characteristics (fog and density).

Japanese Patent Applications Laid-open No. 2-168264, No. 2-235069, No. 5-173363, No. 5-173366 and No. 5-241371 further disclose toner binder resin compositions and toners in which the molecular weights, mixing ratio, acid values and percentages of low-molecular weight components and high-molecular weight components in binder resins are controlled to improve fixing performance, anti-offset properties, image characteristics, anti-blocking performance, charging rise performance and so forth. There, however, is room for further improvement.

In particular, in the adjustment of acid values mentioned above, the dispersibility of colorants such as magnetic iron oxides and the dispersibility of charge control agents (charging controllers) and other additives tend to become poor, to tend to cause fog due to contamination on the surface of a carrier or a developer carrying member such as a developing sleeve, or image deterioration such as a decrease in image density.

For the achievement of much lower-temperature fixing, it is sought to make further improvements.

Japanese Patent Application Laid-open No. 62-9356 discloses a toner binder resin composition comprising a blend of two kinds of vinyl resins having different molecular weights and acid values of resin. However, when such a binder resin is used, kneading conditions must be made strict in order to improve the compatibility and dispersibility of the components constituting the toner. Such a binder resin is liable to undergo a break of polymer molecules, and hence it becomes difficult to exhibit the desired performance on the anti-offset properties. If materials are kneaded to such an extent that the resin may not undergo a break of polymer molecules, the dispersibility of other additives may become poor to accelerate the contamination on the surface of a carrier or a developer carrying member to tend to cause the problems of fog and black spots around line images. Especially when a polymer with a weight average molecular weight of 1,000,000 or more is used, these phenomena tend to appear.

Japanese Patent Application Laid-open No. 3-72505 discloses a vinyl type toner binder resin with a molecular weight of 300,000 or more, employing a polyfunctional initiator. The use of such a resin enables satisfaction of fixing performance to a certain extent, but, in addition to the above problems, tends to cause a lowering of performance when toner is left to stand at high temperatures. The cause of this phenomenon is unclear, and is presumed to be due to the fact that the break of binder resin molecules is accelerated in the production of toner and hence the proportion of high-molecular weight resin components in the toner composition decreases to cause a lowering of thermal resistance.

The various performances required for toners often conflict with one another, and yet in recent years it is sought to satisfy all of them in a high performance. Moreover, it is sought to take a general measure which includes developing performance.

For the achievement of high-speed processing in electrophotographic apparatus as required in recent years, toners are sought to have more low-temperature fixing performance and also have a toner toughness high enough to endure high-speed development and a charging stability high enough to endure long-term running.

However, with regard to the low-temperature fixing performance and toner toughness as aimed herein, it is difficult to achieve both at the same time.

U.S. Pat. No. 3,909,258 discloses a developing method employing a magnetic toner having an electrical conductivity. This is a method in which a conductive magnetic toner is supported on a cylindrical conductive sleeve internally provided with a magnet, and the toner is brought into contact with electrostatic images to carry out development. In this development, in the developing zone, a conductive path is formed between the surface of a photosensitive member and the surface of the sleeve by toner particles, and charges are led from the sleeve to the toner particles through this conductive path, where, the toner particles adhere to image areas by the Coulomb force acting between toner particles and image areas of the electrostatic images. Thus, the electrostatic images are developed. This development carried out using a conductive magnetic toner is a superior method which avoids the problems involved in the conventional two-component development. On the other hand, since the toner is conductive, there is the problem that it is difficult to electrostatically transfer the developed image from the photosensitive member to a final transfer medium such as paper.

As a developing method using a high-resistivity magnetic toner that enables electrostatic transfer, there is a developing method utilizing dielectric polarization of toner particles. Such a method, however, has problems in that the development speed is substantially low and the density of developed images is not well attained.

As other methods using a high-resistivity insulating magnetic toner, methods are known in which toner particles are triboelectrically charged by the mutual friction between toner particles, by the friction between toner particles and a developing sleeve or by the friction between toner particles and a blade or a coating roller, and the toner particles thus charged are moved to an electrostatic image bearing member. Such methods, however, have had the problems that the triboelectric charging tends to become insufficient because of a small number of contact times between the toner particles and the friction member and the toner particles charged tend to agglomerate on the sleeve because of the Coulomb force increased between the toner particles and the sleeve.

Japanese Patent Application Laid-open No. 55-18656 discloses a novel jumping development that has eliminated the above problems. This is a method in which a magnetic toner is very thinly applied to a developing sleeve, and the toner thus applied is triboelectrically charged, which is then conducted very close to electrostatic images to carry out development. According to this method, since the magnetic toner is very thinly applied to the developing sleeve, the opportunities of contact between the developing sleeve and the toner increase to enable sufficient triboelectric charging, and also since the magnetic toner is supported by magnetic force and the magnet and the toner are relatively moved, the toner particles are released from their mutual agglomeration and can be sufficiently brought into friction with the sleeve, whereby superior toner images can be obtained.

However, a finely divided magnetic material is mixed and dispersed in the insulating magnetic toner in a considerable quantity and the magnetic material is partly laid bare to the surfaces of toner particles, and hence the properties of the magnetic material affect the fluidity and triboelectric chargeability of the magnetic toner, consequently tending to cause variation or deterioration of various performances such as developing performance and running performance required in magnetic toners.

In the jumping development making use of a magnetic toner, as a result of continual repetition of a developing step (e.g., copying) over a long period of time, the fluidity of the developer containing the magnetic toner may lower to make it difficult to achieve normal triboelectric charging, so that the charging tends to become non-uniform, and fogging tends to occur in an environment of low temperature and low humidity, tending to cause problems on toner images. In the case where the binder resin and magnetic material constituting magnetic toner particles have a weak adhesion, the magnetic material may come off the surfaces of toner particles as a result of the repeated developing step to tend to adversely affect the toner images, e.g., to cause a decrease in image density.

In the case when the magnetic material is not uniformly dispersed in the magnetic toner particles, magnetic toner particles containing the magnetic material in a large quantity and having small particle diameters may accumulate on the developing sleeve to cause a decrease in image density and an uneven light and shade called sleeve ghost in some instances.

Proposals concerning magnetic iron oxides to be contained in magnetic toners are hitherto made, but there is room for further improvement.

For example, Japanese Patent Applications Laid-open No. 62-279352 and 62-278131 disclose a magnetic toner containing a magnetic iron oxide incorporated with silicon element. In such a magnetic iron oxide, the silicon element is intentionally added inside the magnetic iron oxide, but there is room for further improvement in the fluidity of the magnetic toner containing the magnetic iron oxide.

Japanese Patent Publication No. 3-9045 discloses adding a silicate to control the shape of magnetic iron oxide to be spherical. In the magnetic iron oxide thereby obtained, the silicon element is richly distributed inside the magnetic iron oxide because of the use of the silicate for controlling particle diameter and the silicon element is less present on the surface of the magnetic iron oxide, so that the improvement in fluidity of the magnetic toner tends to become insufficient.

Japanese Patent Application Laid-open No. 61-34070 discloses a process for producing triiron tetraoxide by adding a hydroxosilicate solution to triiron tetraoxide in the course of oxidation reaction. The triiron tetraoxide obtained by this process has silicon element in the vicinity of its surface, but the silicon element is present in layer in the vicinity of the surface of the triiron tetraoxide. Hence, there is the problem that the surface is weak to mechanical shock such as friction.

Japanese Patent Application Laid-open No. 5-72801 discloses a magnetic toner containing magnetic iron oxide incorporated with silicon element and in which 44 to 84% of silicon element of the whole silicon content is present in the vicinity of the surface of the magnetic iron oxide.

The magnetic toner containing such magnetic iron oxide has brought about improvements in the fluidity of toner and the adhesion to binder resin. However, because of the local presence of silicon element in the vicinity of the surface of the magnetic iron oxide particles, such a toner tends to cause a lowering of environmental properties, in particular, a lowering of charging performance when left standing for a long period of time in an environment of high humidity.

Japanese Patent Application Laid-open No. 4-362954 also discloses a magnetic iron oxide containing both silicon element and aluminum element. It, however, is sought to more improve environmental resistance.

Japanese Patent Application Laid-open No. 5-213620 still also discloses a magnetic iron oxide containing a silicon component and in which the silicon component is laid bare to the surface. It, however, is sought to more improve environmental resistance.

Moreover, the above magnetic iron oxide containing silicon element which is largely present in the vicinity of the surface of the magnetic material tends not to be well dispersed in the binder resin. In order to make full use of the excellent properties possessed by the respective constituents of toners, it is required in the designing of toners to select materials having good compatibility and physical mixing properties with the respective components.

SUMMARY OF THE INVENTION

An object of the present invention is to provide a toner for developing electrostatic images that has solved the problems discussed above.

Another object of the present invention is to provide a toner for developing electrostatic images that has been improved in low-temperature fixing performance and anti-offset properties, can form high-quality toner images, has a stable charging performance without causing fog even in a long-term running, and has a superior long-term storage stability.

Still another object of the present invention is to provide a toner for developing electrostatic images that has achieved uniform dispersion of respective components in toner particles and can promise good image characteristics like those at the initial stage even when used for a long time.

A further object of the present invention is to provide a toner for developing electrostatic images that can perform both the low-temperature fixing performance and a high running performance even in a high-speed processing.

A still further object of the present invention is to provide a process cartridge having the above toner.

A still further object of the present invention is to provide an image forming method making use of the above toner.

To achieve the above objects, the present invention provides a toner for developing electrostatic images, comprising a composition containing at least a polymer component and a charge control agent, wherein;

the polymer component;

a) contains substantially no THF-insoluble matter;

b) in a chromatogram in gel permeation chromatography (GPC) for THF-soluble matter of the polymer component, has a main peak in the region of molecular weight of from 3,000 to 30,000 and a subpeak or a shoulder in the region of molecular weight of from 100,000 to 3,000,000; and c) has a low-molecular weight polymer component corresponding to the region of molecular weight less than 50,000 in a chromatogram in GPC, having an acid value ($A_{VL}$) of from 21 to 35 mg·KOH/g, and a high-molecular weight polymer component corresponding to the region of molecular weight not less than 50,000 in the chromatogram in GPC, having an acid value ($A_{VH}$) of from 0.5 to 11 mg·KOH/g; the acid values having a difference of $10 \leqq (A_{VL}-A_{VH}) \leqq 27$.

The present invention also provides a process cartridge comprising an electrostatic image bearing member and a developing means for developing an electrostatic image formed on the electrostatic image bearing member, by the use of a toner;

the electrostatic image bearing member and the developing means being held into one unit as a cartridge; and the process cartridge being detachable from the main body of an image forming apparatus;

wherein;

the toner comprises a composition containing at least a polymer component and a charge control agent, wherein;

the polymer component;

a) contains substantially no THF-insoluble matter;

b) in a chromatogram in gel permeation chromatography (GPC) for THF-soluble matter of the polymer component, has a main peak in the region of molecular weight of from 3,000 to 30,000 and a subpeak or a shoulder in the region of molecular weight of from 100,000 to 3,000,000; and c) has a low-molecular weight polymer component corresponding to the region of molecular weight less than 50,000 in a chromatogram in GPC, having an acid value ($A_{VL}$) of from 21 to 35 mg·KOH/g, and a high-molecular weight polymer component corresponding to the region of molecular weight not less than 50,000 in the chromatogram in GPC, having an acid value ($A_{VH}$) of from 0.5 to 11 mg·KOH/g; the acid values having a difference of $10 \leqq (A_{VL}-A_{VH}) \leqq 27$.

The present invention still also provides an image forming method comprising forming an electrostatic image on an electrostatic image bearing member, and developing the electrostatic image by the use of a toner held in a developing means to form a toner image, wherein;

the toner comprises a composition containing at least a polymer component and a charge control agent, wherein;

the polymer component;

a) contains substantially no THF-insoluble matter;

b) in a chromatogram in gel permeation chromatography (GPC) for THF-soluble matter of the polymer component, has a main peak in the region of molecular weight of from 3,000 to 30,000 and a subpeak or a shoulder in the region of molecular weight of from 100,000 to 3,000,000; and c) has a low-molecular weight polymer component corresponding to the region of molecular weight less than 50,000 in a chromatogram in GPC, having an acid value ($A_{VL}$) of from 21 to 35 mg·KOH/g, and a high-molecular weight polymer component corresponding to the region of molecular weight not less than 50,000 in the chromatogram in GPC, having an acid value ($A_{VH}$) of from 0.5 to 11 mg·KOH/g; the acid values having a difference of $10 \leqq (A_{VL}-A_{VH}) \leqq 27$.

DESCRIPTION OF THE PREFERRED EMBODIMENTS

Figure 1:
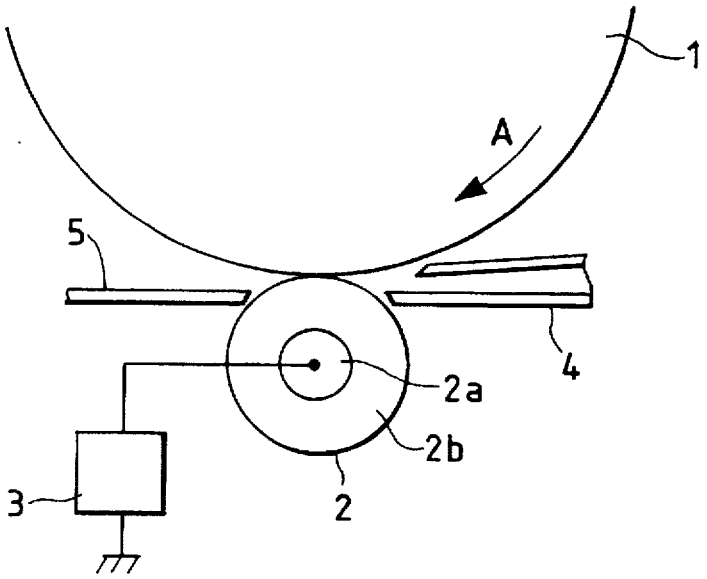
FIG. 1 is a schematic illustration of a transfer assembly.

The toner of the present invention has a composition containing at least a polymer component and a charge control agent. The composition contains substantially no resin component insoluble in tetrahydrofuran (THF-insoluble matter). Stated specifically, the THF-insoluble matter is not more than 5% by weight, and preferably not more than 3% by weight, on the basis of the resin composition.

The THF-insoluble matter referred to in the present invention indicates the weight proportion of a polymer component that has become insoluble in THF (i.e., substantially a cross-linked polymer) in resin compositions of toners, and can be used as a parameter indicating the degree of cross-linking of resin compositions containing cross-linked components. The THF-insoluble matter is defined by a value measured in the following way.

A toner sample is weighed in an amount of from 0.5 to 1.0 g ($W_1$ g), which is then put in a cylindrical filter paper (for example, No. 86R, available from Toyo Roshi K.K.) and set on a Soxhlet extractor. Extraction is carried out for 6 hours using from 100 to 200 ml of THF as a solvent, and the soluble component extracted by the use of the solvent is evaporated, followed by vacuum drying at 100° C. for several hours. Then the THF-soluble resin component is weighed ($W_2$ g). The weight of components other than the resin components, such as a magnetic material and a pigment contained in the toner, is represented by $W_3$ g. The THF-insoluble matter is determined from the following expression.

$$THF\text{-insoluble matter } (\%)=[\{W_1-(W_3+W_2)\}/(W_1-W_3)]\times 100$$

A resin composition containing the THF-insoluble matter in an amount exceeding 5% by weight not only causes a lowering of fixing performance but also is not preferable in view of its matching for the heat-fixing assembly used in Examples of the present invention.

The polymer component in the resin composition in the toner of the present invention has, in a chromatogram in gel permeation chromatography (GPC) for THF-soluble matter of the polymer component, a main peak (major peak) in the molecular weight region of from 3,000 to 30,000, and more preferably from 5,000 to 20,000, and a subpeak (minor peak) or a shoulder in the molecular weight region of from 100,000 to 3,000,000, and more preferably from 500,000 to 1,000,000.

In the above chromatogram of GPC, the polymer component showing a molecular weight of 1,000,000 or more may preferably show an area ratio of from 3 to 10%. The 3 to 10% presence of the polymer component soluble in THF with a molecular weight of 1,000,000 or more brings about an improvement in anti-offset properties without inhibiting the low-temperature fixing performance and at the same time enables improvement of even the storage stability when the toner is left standing in an environment of high humidity.

In the present invention, the molecular weight distribution of the polymer component in the resin composition is measured by GPC (gel permeation chromatography) under the conditions shown below.

Conditions for GPC Measurement of Resin Compositions and Polymers

Apparatus: GPC-150C (Waters Co.)

Column: Combination of seven columns KF801–KF807 (Showdex Co.)

Temperature: 40° C.

Solvent: THF (tetrahydrofuran)

Flow rate: 1.0 ml/min

Sample: Sample in a concentration of 0.05 to 0.5% by weight is injected in an amount of 0.1 ml.

The polymer component used in the present invention has, as one of features thereof, a low-molecular weight polymer component (corresponding to the molecular weight region of less than 50,000 in a chromatogram in GPC) having an acid value ($A_{VL}$) of from 21 to 35 mg·KOH/g, and a high-molecular weight polymer component (corresponding to the molecular weight region of not less than 50,000 in the chromatogram in GPC) having an acid value ($A_{VH}$) of from 0.5 to 11 mg·KOH/g.

The present inventors have discovered as a result of extensive studies that, in the resin composition having a low-molecular weight polymer component and a high-molecular weight polymer component, it is effective for the respective polymer components to have the above acid values, in order to improve low-temperature fixing performance, anti-offset properties and also developing performance.

The low-temperature fixing performance is affected by the Tg and molecular weight distribution of the low-molecular weight polymer component. When this component contains an acid component and is also made to have an acid value greater by at least 10 mg·KOH/g than the acid value of the high-molecular weight polymer component, the resin composition can be made to have a lower viscosity than those having a like Tg and a like molecular weight distribution, but having an acid value outside the above range.

This is presumably because the setting of the acid value lower by at least 10 mg·KOH/g (acid value of 0.5 to 11 mg·KOH/g) in the high-molecular weight polymer component than in the low-molecular weight polymer component controls the entanglement of molecular chains of the low-molecular weight polymer component and high-molecular weight polymer component to a certain extent and hence the resin composition can be made to have a lower viscosity on the side of low temperature and also maintain elastic properties on the side of high temperature. This leads to the achievement of low-temperature fixing and improvement in developing performance in high-speed machines.

On the other hand, if the difference of their acid values exceeds 27 mg·KOH/g, a difficulty in miscibility may occur when the low-molecular weight polymer component and the high-molecular weight polymer component are mixed, to cause a lowering of anti-offset properties and developing performance.

As an additional advantage, the charging rise performance is improved when the low-molecular weight polymer component has an acid value of 21 mg·KOH/g or more.

On the other hand, if the low-molecular weight polymer component has an acid value exceeding 35 mg·KOH/g, the environmental properties, in particular, developing performance in an environment of high humidity may lower.

If the high-molecular weight polymer component has an acid value less than 0.5 mg·KOH/g, a difficulty in miscibility may occur when it is mixed with the low-molecular weight polymer component (acid value of 21 to 35 mg·KOH/g) to cause a lowering of developing performance, in particular, anti-fogging properties.

The polymer component may preferably have a ratio of acid value/total acid value of 0.7 or less, and more preferably from 0.4 to 0.6. If the ratio of acid value/total acid value is more than 0.7, the charging balance of the toner, i.e., the balance of charging-discharging is inclined to charging to tend to cause a lowering of charging stability of the toner.

The polymer component may preferably have, in a chromatogram in GPC for THF-soluble matter of the polymer component, a minimum value (Min) in the molecular weight region of from 30,000 to 100,000. In order to achieve both of the low-temperature fixing performance and the high-temperature anti-offset properties, it is preferable for the low-molecular weight polymer component and the high-molecular weight polymer component to form molecular weight distributions independent of each other.

The polymer component of the resin composition in the toner of the present invention may preferably satisfy the relationship between the low-molecular weight polymer component ($W_L$) and the high-molecular weight polymer component ($W_H$), of:

$$W_L:W_H=50:50 \text{ to } 90:10$$

which concerns their mixing proportion. The reason therefor is that the fixing performance and the anti-offset properties are improved when the proportion of the low-molecular weight polymer component and high-molecular weight polymer component is within this range. More specifically, if the low-molecular weight polymer component is less than 50% by weight, the fixing performance may lower and, on the other hand, if the high-molecular weight polymer component is less than 10% by weight, the high-temperature anti-offset properties may become low.

In the relationship between the amount of these components and their acid values, the polymer component may preferably satisfy the following.

$$A_{VL}\times W_L/(W_L+W_H)\geqq A_{VH}\times W_H/(W_L+W_H)\times 4$$

$$11\leqq(W_L+W_H)^{-1}(A_{VL}W_L+A_{VH}W_H)\leqq 30$$

The reason therefor is as follows: If the amount of the low-molecular weight polymer component and high-molecular weight polymer component mixed and the acid values of the respective components do not satisfy the above relationship, i.e., in the case of:

$$A_{VL}\times W_L/(W_L+W_H)<A_{VH}\times W_H/(W_L+W_H)\times 4,$$

where the acid value held by the low-molecular weight polymer component in the whole resin is lower than the 4-fold value of the acid value held by the high-molecular weight polymer component in the whole resin, the miscibility of the low-molecular weight polymer component with the high-molecular weight polymer component increases to tend to make it difficult to more exhibit the viscosity on the side of low temperature and the high elasticity on the side of high temperature.

As for the value of $(W_L+W_H)^{-1}(A_{VL}W_L+A_{VH}W_H)$, if it is less than 11, the charging rise performance tends to lower. On the other hand, if it is more than 30, the developing performance in an environment of high humidity tends to lower.

In the present invention, the acid values (JIS acid value) of the low-molecular weight polymer component and high-molecular weight polymer component are obtained in the following way.

Fractional Collection of Each Component

Apparatus constitution

LC-908 (manufactured by Nihon Bunseki Kogyo K.K.)

JRS-86 (ditto; a repeat injector)

JAR-2 (ditto; an auto-sampler)

FC-201 (Gilson Corp.; a fraction collector)

Column constitution

JAIGEL-1H to -5H (20 diameter×600 mm; preparative columns)

Measurement conditions

Temperature: 40° C.

Solvent: THF

Flow rate: 5 ml/minute

Detector: RI

From the sample, additives other than polymer components are beforehand separated. To fractionate the components, the elution time taken for the molecular weight to come to be 50,000 is beforehand measured, and the low-molecular weight polymer component and the high-molecular weight polymer component respectively are fractionated before and after that time. Samples thus fractionated, from which the solvent has been removed, are used as samples for the measurement of acid values.

Measurement of Acid Value (JIS Acid Value)

1) A pulverized product of a sample is precisely weighed in an amount of from 0.1 to 0.2 g, and its weight is represented by W (g).

2) The sample is put in a 20 cc Erlenmeyer flask, to which 10 cc of a toluene/ethanol (2:1) mixed solvent is added to carry out dissolution.

3) As an indicator, several drops of an alcohol solution of phenolphthalein is added.

4) The solution in the flask is titrated with an alcohol solution of 0.1N KOH by means of a buret.

The amount of the KOH solution used in this titration is represented by S (ml). A blank test is also made, and the amount of the KOH solution used in this test is represented by B (ml).

5) The acid value is calculated according to the following expression.

$$\text{Acid value}=(S-B)\times f\times 5.61/W$$

(f: factor of KOH solution)

In the present invention, the total acid value is measured in the following way.

Measurement of Total Acid Value

1) From a sample, additives other than polymer components are removed before its use. A pulverized product of the sample is precisely weighed in an amount of about 2 g, and its weight is represented by W' (g).

2) The sample is put in a 200 cc Erlenmeyer flask, to which 30 cc of 1,4-dioxane, 10 cc of pyridine and 20 mg of 4-dimethylaminopyridine are added to carry out dissolution for 1 hour.

3) 3.5 cc of ion-exchanged water is added to reflux the solution for 4 hours, followed by cooling.

4) As an indicator, several drops of an alcohol solution of phenolphthalein are added.

5) The solution in the flask is titrated with a THF solution of 0.1N KOH by means of a buret.

The amount of the KOH solution used in this titration is represented by S' (ml). A blank test is also made, and the amount of the KOH solution used in this test is represented by B' (ml).

6) The total acid value is calculated according to the following expression.

$$\text{Total acid value}=(S'-B')\times f'\times 5.61/W'$$

(f': factor of KOH solution)

As the THF solution of KOH, a solution is used which is prepared by adding and dissolving 6.6 g of KOH in 20 cc of ion-exchanged water, followed by further addition of 720 cc of THF and 100 cc of ion-exchanged water, and thereafter adding methanol with stirring until the solution becomes transparent.

Monomers for adjusting the acid values of the polymer components include, for example, acrylic acid, and α- or β-alkyl derivatives thereof such as methacrylic acid, a-ethylacrylic acid and crotonic acid, and unsaturated dicarboxylic acids and monoester derivatives thereof such as fumaric acid, maleic acid and citraconic acid. Any of such monomers used alone or in combination may be copolymerized with other monomers to make desired polymers. Among these, especially, use of monoester derivatives of unsaturated dicarboxylic acids is preferred in order to control the value of acid value/total acid value.

Such derivatives may specifically include monoesters of α,β-unsaturated dicarboxylic acids as exemplified by monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; monoesters of alkenyl dicarboxylic acids as exemplified by monobutyl n-butenyl succinate, monomethyl n-octenyl succinate, monoethyl n-butenyl malonate, monomethyl n-dodecenyl glutarate and monobutyl n-butenyl adipate; and monoesters of aromatic dicarboxylic acids as exemplified by monomethyl phthalate, monoethyl phthalate and monobutyl phthalate.

Any of the carboxyl group-containing monomers as shown above may be added in an amount of from 1 to 20% by weight, and preferably from 3 to 15% by weight, based on the weight of the whole monomers constituting the high-molecular weight side of the binder resin.

The reason why the monoester monomers of dicarboxylic acids as shown above are selected is that in the suspension polymerization it is not suitable for the monomers to be used in the form of acid monomers having a high solubility in an aqueous suspension, and it is preferable to be used in the form of esters having a low solubility in the same.

In the present invention, the carboxylic acid groups and carboxylate moieties in the copolymers obtained in the manner as described above may be subjected to an alkali treatment to effect saponification. It is preferable to make them react with cationic components of an alkali so that the carboxylic acid groups or carboxylate moieties are converted into polar functional groups. This is because, even when carboxyl groups capable of reacting with a metal-containing compound are contained in the high-molecular weight polymer component of the binder resin, the efficiency of cross-linking reaction may lower if the carboxyl groups are made anhydrous (i.e., a ring closure state).

This alkali treatment may be applied after the production of the binder resin, by charging an alkali in the form of a solution into the solvent used in polymerization, and while stirring the mixture. The alkali that can be used in the present invention may include hydroxides of alkali metals or alkaline earth metals such as Na, K, Ca, Li, Mg and Ba; hydroxides of transition metals such as Zn, Ag, Pb and Ni; and hydroxides of quaternary ammonium salts such as ammonium salts, alkyl ammonium salts and pyridinium salts. As particularly preferred examples, may be named NaOH and KOH.

In the present invention, the above saponification may be not necessarily effected over all the carboxylic acid groups and carboxylate moieties in the copolymer, and the saponification may proceed in part to convert some of them into polar functional groups.

The amount of the alkali used in the reaction of saponification depends on the type of the polar groups in the binder resin, the manner of dispersion and the type of component monomers, and is difficult to absolutely determine. It may be in 0.02- to 5-fold equivalent weight of the acid value of the binder resin. If it is less than 0.02-fold equivalent weight, the reaction of saponification may proceed insufficiently to make small the number of polar functional groups produced by the reaction, resulting in a decrease in the reactivity of the subsequent cross-linking reaction. If on the other hand it is more than 5-fold equivalent weight, the functional groups at the carboxylate moieties or the like tend to be adversely affected because of the formation of salts as a result of dehydration of esters or saponification.

When the alkali treatment is applied in the amount of 0.02- to 5-fold equivalent weight of the acid value, the cations remaining after the treatment can be in a concentration within the range of from 5 ppm to 1,000 ppm, and can be preferably used to define the amount of the alkali.

The resin composition used in the present invention may preferably have a glass transition temperature (Tg) of from 50° to 70° C., and preferably from 55° to 65° C. If the Tg is lower than 50° C., the toner tends to deteriorate in an environment of high humidity and the offset tends to occur at the time of fixing. If on the other hand the Tg is higher than 70° C., the fixing performance tends to lower.

$Tg_L$ and $Tg_H$ of the low-molecular weight polymer component and high-molecular weight polymer component of the resin composition, respectively, may preferably be in the relationship within the range of:

$$Tg_L \geqq Tg_H - 5 \text{ (°C.)}.$$

If the $Tg_L$ is less than $Tg_H-5$, the developing performance tends to lower. More preferably, $Tg_L \geqq Tg_H$.

The composition as binder resin used in the present invention can be prepared by methods including a solution blend method in which the high-molecular weight polymer component and the low-molecular weight polymer component are separately synthesized by solution polymerization and thereafter these are mixed in the state of a solution, followed by desolvation; a dry blend method in which they are melt-kneaded by means of an extruder or the like; and a two-stage polymerization method in which a solution of a low-molecular weight polymer component obtained by solution polymerization is dissolved in monomers constituting the high-molecular weight polymer component to carry out suspension polymerization, followed by washing with water and drying to obtain a resin composition. However, the dry blend method has a problem in respect of uniform dispersion and compatibilization. The two-stage polymerization method has many advantages in respect of uniform dispersion and so forth. It, however, has a difficulty in making the low-molecular weight polymer component more than the high-molecular weight polymer component and has a difficulty in synthesizing the high-molecular weight polymer component with a large molecular weight in the presence of the low-molecular weight polymer component, and further has the problem or disadvantage that, e.g., unnecessary low-molecular weight polymer component may be formed as a by-product. Hence, the solution blend method is most preferable. As a method for introducing a given acid value into the low-molecular weight polymer component, solution polymerization is preferred, which enables easier setting of acid value than aqueous polymerization.

Polymerization methods that can be used in the present invention as a method for synthesizing the high-molecular weight polymer may include solution polymerization, emulsion polymerization and suspension polymerization.

Of these, the emulsion polymerization is a method in which monomers almost insoluble in water are dispersed with an emulsifying agent in an aqueous phase in the form of small particles to carry out polymerization using a water-soluble polymerization initiator. This method enables easy control of reaction heat, and requires only a small rate of termination reaction since the phase where the polymerization is carried out (an oily phase formed of polymers and monomers) is separate from the aqueous phase, so that a product with a high polymerization concentration and a high degree of polymerization can be obtained. Moreover, since the polymerization process is relatively simple and the polymerization product is in the form of fine particles, colorants, charge control agents and other additives can be mixed with ease when the toner is produced.

However, the polymer tends to become impure because of the emulsifying agent added, and an operation such as salting-out is required to take out the polymer. In order to avoid such disadvantages, the suspension polymerization is advantageous.

In the suspension polymerization, the reaction may preferably be carried out using monomers in an amount of not less than 100 parts by weight, and preferably from 10 to 90 parts by weight, based on 100 parts by weight of an aqueous solvent. Usable solvents include polyvinyl alcohol, partially saponified polyvinyl alcohol and calcium phosphate, any of which may be used usually in an amount of from 0.05 to 1 part by weight based on 100 parts by weight of the aqueous solvent. Polymerization temperature may be from 50° to 95° C. as a suitable range, and may be appropriately selected depending on the initiator used and the intended polymer.

In order to achieve the object of the present invention, the high-molecular weight polymer used in preparing the resin composition may preferably be produced using a polyfunctional polymerization initiator or monofunctional polymerization initiator as exemplified below.

As examples of a polyfunctional polymerization initiator having a polyfunctional structure, may be named polyfunctional polymerization initiators having in a molecule two or more functional groups such as peroxide groups, having a polymerization initiating function, as exemplified by 1,1-di-t-butylperoxy-3,3,5-trimethylcyclohexane,
1,3-bis(t-butylperoxyisopropyl)benzene,
2,5-dimethyl-2,5-(t-butylperoxy)hexane,
2,5-dimethyl-2,5-di-(t-butylperoxy)hexyne-3,
tris-(t-butylperoxy)triazine,
1,1-di-t-butylperoxycyclohexane,
2,2-di-t-butylperoxybutane, 4,4-di-t-butylperoxyvaleric acid-n-butyl ester,
di-t-butylperoxyhexahydroterephthalate,
di-t-butylperoxyazelate,
di-t-butylperoxytrimethyladipate,
2,2-bis(4,4-di-t-butylperoxycyclohexyl)propane,
2,2-di-t-butylperoxyoctane, and various polymer oxides; and polyfunctional polymerization initiators having in a molecule both a functional group such as a peroxide group, having a polymerization initiating function, and a polymerizable unsaturated group, as exemplified by
diallylperoxydicarbonate, t-butylperoxymaleate,
t-butylperoxyallylcarbonate, and
t-butylperoxyisopropylfumarate.

Of these, more preferred ones are 1,1-di-t-butylperoxy-3,3,5-trimethylcyclohexane,
1,1-di-t-butylperoxycyclohexane,
di-t-butylperoxyhexahydroterephthalate,
di-t-butylperoxyazelate,
2,2-bis(4,4-di-t-butylperoxycyclohexyl)propane, and
t-butylperoxyallylcarbonate.

In order to satisfy various performances required as binders for the toner, any of these polyfunctional polymerization initiators may preferably be used in combination with a monofunctional polymerization initiator. In particular, they may preferably be used in combination with a polymerization initiator having a half-life of 10 hours at a temperature lower than the decomposition temperature necessary for the polyfunctional polymerization initiator to obtain a half-life of 10 hours.

Such a monofunctional polymerization initiator may specifically include organic peroxides such as benzoylperoxide,
1,1-bis(t-butylperoxy)-3,3,5-trimethylcyclohexane,
n-butyl-4,4-di(t-butylperoxy)valerate, dicumylperoxide,
α,α'-bis(t-butylperoxydiisopropyl)benzene,
t-butylperoxycumene, and di-t-butylperoxide; and azo or diazo compounds such as azobisisobutylonitrile and diazoaminoazobenzene.

Any of these monofunctional polymerization initiators may be added in the monomers at the same time the polyfunctional polymerization initiator is added. However, in order to keep a proper efficiency of the polyfunctional polymerization initiator, the monofunctional polymerization initiator may preferably be added after the half-life shown by the polyfunctional polymerization initiator has lapsed.

Any of these polymerization initiators may preferably be added in an amount of 0.05 to 2 parts by weight based on 100 parts by weight of the monomers, in view of efficiency.

In order to well achieve the object of the present invention, the high-molecular weight polymer component may preferably have been cross-linked with a cross-linkable monomer as exemplified below.

As the cross-linkable monomer, a monomer having at least two polymerizable double bonds may be used, which may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether bond, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether bond, as exemplified by
polyoxythylene(2)-2,2-bis(4-hydroxyphenyl)propane diacrylate,
polyoxythylene(4)-2,2-bis(4-hydroxyphenyl)propane diacrylate, and the above compounds whose acrylate moiety has been replaced with methacrylate; and polyester type diacrylate compounds as exemplified by MANDA (trade name; available from Nippon Kayaku Co., Ltd.). Polyfunctional cross-linkable monomers may include pentaerythritol triacrylate, trimethylolethane triacrylate, trimethylolpropane triacrylate, tetramethylolpropane triacrylate, tetramethylolmethane tetraacrylate, oligoester acrylate, and the above compounds whose acrylate moiety has been replaced with methacrylate; triallylcyanurate, and triallyltrimellitate.

Any of these cross-linkable monomers may preferably be used in an amount of 1 part by weight or less, and preferably from 0.001 to 0.05 part by weight, based on 100 parts by weight of other monomer components.

Of these cross-linkable monomers, monomers preferably usable in view of the fixing performance and anti-offset properties of the toner are aromatic divinyl compounds (in particular, divinylbenzene) and diacrylate compounds linked with a chain containing an aromatic group and an ether bond.

As methods for synthesizing the low-molecular weight polymer component, known methods may be used. In bulk polymerization, polymers with a low-molecular weight can be obtained by polymerizing monomers at a high temperature and accelerating the rate of termination reaction, but there is the problem of a difficulty in controlling the reaction. In this regard, in solution polymerization, which utilizes a difference in chain transfer of radicals that is caused by a solvent, low-molecular weight polymers can be obtained with ease under mild conditions while controlling the quantity of initiators and the reaction temperature. Thus, this method is particularly preferred in order to obtain the low-molecular weight polymer used in the resin composition. Especially in view of controlling to a minimum the quantity of polymerization initiators used and preventing the effect of initiator residues as far as possible, solution polymerization carried out under application of pressure is also preferable.

Monomers for obtaining the high-molecular weight polymer component and monomers for obtaining the low-molecular weight polymer component may include the following.

They can be exemplified by styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylenically unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide. Any of these vinyl monomers may be used alone or in a combination of two or more monomers.

Of these, monomers may preferably be used in such a combination as may give a styrene copolymer and a styrene-acrylic copolymer.

In view of miscibility, both the low-molecular weight polymer component and the high-molecular weight polymer component may preferably contain at least 65 parts by weight of the styrene polymer component or styrene copolymer component.

The high-molecular weight polymer constituting the resin composition may be previously mixed with a low-molecular weight wax. This is preferable since the phase separation in micro-regions can be moderated, the reaglomeration of polymeric components can be prevented and also a good state of dispersion for the low-molecular weight polymer component can be attained.

Low-molecular weight waxes that can be used in the present invention may include compounds such as polypropylene wax, polyethylene wax, microcrystalline wax, carnauba wax, sazole wax, paraffin wax, higher alcohol type wax and ester wax, and oxides or graft-modified products of these.

These low-molecular weight waxes may preferably be those having a weight average molecular weight of not more than 30,000, and preferably not more than 10,000, and any of these may be added in an amount of from 1 to 20 parts by weight based on 100 parts by weight of the polymer component.

These low-molecular weight wax may preferably be added and mixed in advance in the polymer components when the toner is produced. In particular, when the polymer components are prepared, it is preferred that the low-molecular weight wax and the high-molecular weight polymer component are preliminarily dissolved in a solvent and thereafter the solution is mixed with a low-molecular weight polymer solution.

The polymer solution thus prepared may preferably have a solid concentration of 5 to 70% by weight or less, taking account of dispersion efficiency, prevention of change in properties at the time of stirring, operability and so forth. The preliminary solution of the high-molecular weight polymer and the low-molecular weight wax may preferably have a solid concentration of not more than 5 to 60% by weight, and the low-molecular weight polymer solution, not more than 5 to 70% by weight.

The high-molecular weight polymer and the low-molecular weight wax can be dissolved or dispersed by mixing them with stirring. The stirring may preferably be carried out by a batch system or a continuous system.

The preliminary solution can be mixed with the low-molecular weight polymer solution by adding the low-molecular weight polymer solution in an amount of from 10 to 1,000 parts by weight based on 100 parts by weight of the preliminary solution, followed by mixing with stirring. This mixing may be carried out by either a batch system or a continuous system.

Organic solvents used when the solutions for the resin composition are mixed may include hydrocarbon solvents such as benzene, toluole, xylole, solvent naphtha No. 1, solvent naphtha No. 2, solvent naphtha No. 3, cyclohexane, ethylbenzene, Solvesso 100, Solvesso 150 and mineral spirits; alcohol type solvents such as methanol, ethanol, isopropyl alcohol, n-butyl alcohol, sec-butyl alcohol, iso-butyl alcohol, amyl alcohol and cyclohexanol; ketone type solvents such as acetone, methyl ethyl ketone, methyl isobutyl ketone and cyclohexanone; ester type solvents such as ethyl acetate, n-butyl acetate and cellosolve acetate; and ether type solvents such as methyl cellosolve, ethyl cellosolve, butyl cellosolve and methyl carbitol. Of these, aromatic solvents, ketone type solvents or ester type solvents are preferred. These may be used in combination.

As methods for removing the organic solvent, it is preferable to use a method in which the organic solvent solution of polymers is heated, thereafter 10 to 80% by weight of the organic solvent is removed under normal pressure and then the remaining solvent is removed under reduced pressure. During this operation, the organic solvent solution may preferably be kept at the boiling point of the organic solvent used or up to 200° C.

If its temperature is lower than the boiling point of the organic solvent, not only the solvent is removed in a poor efficiency, but also an unwanted shear may be applied to the polymers dissolved in the organic solvent or the redispersion of the respective constituent polymers may be accelerated to cause phase separation in a microscopic state. A temperature higher than 200° C. is not preferable since the polymers tend to undergo depolymerization, oligomers tend to be formed as a result of molecular break and impurities tend to be included in the resin composition.

The present inventors have discovered that controlling the outermost surface, composition and structure of magnetic iron oxide makes it possible for a magnetic toner containing the magnetic iron oxide, to have a superior fluidity and very good properties in respect of long-term storage stability, running performance and magnetic material dispersibility in toner.

In the present invention, such magnetic iron oxide used in the magnetic toner has silicon element preferably in a content of from 0.1 to 5.0% by weight, more preferably from 0.4 to 2.0% by weight, and still more preferably from 0.5 to 0.9% by weight, on the basis of iron element.

If the silicon element is in a content less than 0.4% by weight or the atomic ratio of Fe/Si is greater than 4.0, the improvement on the magnetic toner, in particular, the improvement in fluidity of the magnetic toner can not be so much effective. If the silicon element is in a content more than 2.0% by weight or the atomic ratio of Fe/Si is less than 1.2, the environmental properties, in particular, the charging performance in long-term storage in an environment of high humidity tends to lower. The running performance of toner and the dispersibility of magnetic iron oxide in binder resin also tend to decrease.

As preferable magnetic iron oxide particles, silicon oxide should be present on the particle surfaces of the magnetic iron oxide in an amount of from 0.01 to 1.00% by weight, and more preferably from 0.05 to 0.3% by weight, in terms of $SiO_2$. If the silicon oxide on the magnetic iron oxide particle surfaces is less than 0.01% by weight in terms of $SiO_2$, the improvement in the fluidity of the magnetic toner can be less effective. If on the other hand it is more than 1.00% by weight, the environmental properties, in particular, the charging performance in long-term storage in an environment of high humidity tends to lower.

As preferable magnetic iron oxide particles, they should have a smoothness of from 0.3 to 0.8, preferably from 0.45 to 0.7, and more preferably from 0.5 to 0.7. The smoothness in the present invention has relation to the amount of pores at the surfaces of magnetic iron oxide particles. A smoothness of less than 0.3 is not preferable since the pores at the surfaces of the magnetic iron oxide particles are present in a large number to increase the tendency of adsorbing a moisture.

As preferable magnetic iron oxide particles, they should also have a bulk density of 0.8 g/cm$^3$ or more, and preferably 1.0 g/cm$^3$ or more. If their bulk density is less than 0.8 g/cm$^3$, the physical properties of their blending with other toner materials when the toner is produced tends to lower and the magnetic material dispersibility in toner particles tends to decrease.

As preferable magnetic iron oxide particles, they should still also have a BET specific surface area of 15.0 m$^2$/g or less, and preferably 12.0 m$^2$/g or less. If the BET specific surface area exceeds 15.0 m$^2$/g, the moisture adsorptivity of the magnetic iron oxide particles increases to tend to cause a decrease in triboelectric chargeability of the toner.

The moisture adsorptivity of the magnetic iron oxide is greatly concerned with the pores present at its particle surfaces, and it is important to control pore distribution. When viewed from the pore distribution, the magnetic iron oxide particles may preferably have a total pore volume of from $7.0\times10^{-3}$ to $15.0\times10^{-3}$ ml/g, and more preferably from $8.0\times10^{-3}$ to $12.0\times10^{-3}$ ml/g.

If the total pore volume is less than $7.0\times10^{-3}$ ml/g, the adhesion to the binder resin tends to decrease, and the magnetic iron oxide particles tend to come off the toner particles, resulting in a decrease in image density. The pores at the surfaces of magnetic iron oxide particles are also greatly concerned with the adsorption of moisture, and greatly affect the moisture adsorption properties of the toner containing the magnetic iron oxide particles. The surface moisture content of toner particles is greatly concerned with the charging performance of the toner.

If the surface total pore volume of the magnetic iron oxide particles is less than $7.0\times10^{-3}$ ml/g, the moisture holdability of the magnetic iron oxide particles may decrease. Especially in an environment of low humidity, the toner containing such magnetic iron oxide particles tends to cause charge-up and tends to cause a decrease in image density.

If the total pore volume exceeds $15.0\times10^{-3}$ ml/g, the moisture adsorptivity of the magnetic iron oxide particles may increase. Especially in an environment of high humidity, the toner containing such magnetic iron oxide particles tends to adsorb moisture when left standing in such an environment, so that a decrease in charge quantity may be caused, resulting in a decrease in image density.

The magnetic iron oxide particles used in the present invention may further preferably have a surface pore distribution wherein the total specific surface area of pores with pore diameters smaller than 20 Å (micropores) is not greater than the total specific surface area of pores with pore diameters not smaller than 20 Å (20 Å to 500 Å) (mesopores).

The diameter of the surface pores of magnetic iron oxide particles greatly affects the adsorption of moisture. Small pores make it difficult for adsorbed moisture to be desorbed. If in the magnetic iron oxide particles the total specific surface area of pores with pore diameters smaller than 20 Å exceeds the total specific surface area of pores with pore diameters not smaller than 20 Å, it follows that the particles have more adsorption sites from which the adsorbed moisture is desorbed with difficulty, so that the toner containing such magnetic iron oxide particles tends to cause a lowering of its charging performance especially when left standing for a long term in an environment of high humidity.

The magnetic iron oxide particles may still further preferably bring about substantially no hysteresis in isotherms on the adsorption side and desorption side in nitrogen adsorption-desorption isotherms. The difference in adsorbed gas quantity between adsorption and desorption at an arbitrary relative pressure in the isotherms may preferably be 4% or less.

Occurrence of the hysteresis (i.e., a lag) in the nitrogen adsorption-desorption isotherms means that the pores of particles have narrow pore entrances and the particles have pores of an ink bottle type in which the insides of pores widen, having such a structure that adsored substance (moisture) is hard to desorb. Thus, with the toner containing such magnetic iron oxide particles, the charging performance tends to lower especially in an environment of high humidity.

The magnetic iron oxide particles still further preferably has a moisture content of from 0.4 to 1.0% by weight, and more preferably from 0.45 to 0.90% by weight, at 23.5° C./65% RH, and a moisture content of from 0.6 to 1.5% by weight, and more preferably from 0.60 to 1.10% by weight, at 32.5° C./85% RH, and also has the difference in moisture content between the respective environments, of 0.6% by weight or less, and more preferably 0.3 or less.

If the moisture content is lower than the above ranges, the toner tends to cause charge-up especially in an environment of low humidity. If it is higher than the above ranges, the quantity of triboelectricity tends to decrease. Also, a case where the difference in moisture content between the respective environments exceeds 0.6% by weight is not preferable since a difference in image characteristics may be caused by the difference in environment.

The magnetic iron oxide particles may still further preferably be treated with an aluminum hydroxide containing 0.01 to 2.0% by weight, and more preferably from 0.05 to 1.0% by weight, of aluminum element.

Although the reason is unclear, as a result of the treatment of the magnetic iron oxide particle surfaces with the aluminum hydroxide, the toner can have more stable charging performance. If the aluminum element is less than 0.01% by weight, the treatment is less effective. On the other hand, if it is more than 2.0% by weight, the environmental properties of the toner, in particular, the charging performance in an environment of high humidity tends to lower.

The magnetic iron oxide particles used in the present invention may preferably have an average particle diameter of from 0.1 to 0.4 μm, and preferably from 0.1 to 0.3 μm.

Use of the magnetic iron oxide particles containing the silicon element, in combination with the polymer component whose acid values have been adjusted according to the present invention brings about a dramatic improvement in developing performance such as charging performance, running performance (durability), image characteristics (reproducibility and fog). This is presumably because the "wetting" at interfaces between the polymer component and the magnetic iron oxide particles has been appropriately improved and the dispersibility in the resin composition has been improved.

The data of physical properties of the magnetic iron oxide particles are measured in the manner as described below.

(1) Surface $SiO_2$ quantity of magnetic iron oxide particles:

The surface $SiO_2$ quantity of the magnetic iron oxide particles is determined in the following way.

To 15 g of a sample, 300 ml of an aqueous 1N NaOH solution is added to carry out ultrasonic dispersion (10 minutes). Next, the resulting dispersion is heated to 50° C. and stirred for 30 minutes. Thereafter, the supernatant formed is separated by a centrifugal separator (10,000 rpm; 10 minutes). An aqueous 1N NaOH solution is again added to carry out ultrasonic dispersion (5 minutes), followed by centrifugation to remove the supernatant, and the solid content is dried. Samples before and after this alkali washing are put in a fluorescent X-ray analyzer to make measurement and determination to calculate the surface $SiO_2$ quantity.

(2) Bulk density:

The bulk density of the magnetic iron oxide particles is measured according to the pigment test method prescribed in JIS-K-5101.

(3) Smoothness:

Smoothness D of the magnetic iron oxide particles is determined in the following way.

$$\text{Smoothness} = \frac{\text{Surface area } (m^2/g) \text{ of magnetic iron oxide calculated from average particle diameter}}{\text{BET } (m^2/g) \text{ of magnetic iron oxide actually measured}}$$

(4) BET specific surface area:

The BET specific surface area of the magnetic iron oxide particles is measured in the following way.

The BET specific surface area is determined by the BET multi-point method, using a full-automatic gas adsorption measuring device AUTOSORB-1, manufactured by Yuasa Ionics Co., Ltd., and using nitrogen as adsorbing gas. As pretreatment, the sample is deaerated at 50° C. for 10 hours.

(5) Average particle diameter and surface area of magnetic iron oxide particles:

The measurement of average particle diameter and the calculation of surface area of the magnetic iron oxide are made in the following way.

A photograph of magnetic powder is taken on a transmission electron microscope in 40,000 magnifications, and 250 particles are selected at random on the photograph. Thereafter, the Martin's diameters in projected diameters (the length of a segment of a line that bisects the projected area in a given direction) are measured, and the measurements are indicated as a number average particle diameter.

To calculate the surface area, the magnetic iron oxide particles are assumed as spheres where the average particle diameter of the magnetic iron oxide particles is regarded as the diameter of each magnetic iron oxide particle. The density of magnetic iron oxide is measured by a conventional method, and then the surface area of the magnetic iron oxide particles is determined.

(6) Pore distribution:

The total pore volume according to nitrogen gas adsorption-desorption isotherms, the total specific surface area of pores with pore diameters smaller than 20 Å and the total specific surface area of pores with pore diameters not smaller than 20 Å, of the magnetic iron oxide particles are determined in the following way.

Using as a measuring device a full-automatic gas adsorption device AUTOSORB-1, manufactured by Yuasa Ionics Co., Ltd., and using nitrogen as adsorbing gas, 40-point of adsorption and 40-point of desorption are measured at relative pressures of 0 to 1.0, and pore distributions are measured by the de Boer's t-prot method, the Kelvin's formula and the B.J.H. method to determine corresponding values. As pretreatment, samples are deaerated at 50° C. for 10 hours.

(7) Moisture content:

The moisture content of the magnetic iron oxide particles is determined in the following way.

Magnetic iron oxide particles are left standing for 3 days in an environment of temperature of 23.5° C. and relative humidity 65% and an environment temperature 32.5° C. and relative humidity 65%. Thereafter, the samples are heated to 130° C. to measure their moisture contents while aerating the particles with 0.2 liter/min of a nitrogen gas carrier, using a trace moisture content measuring device Model AQ-6 and an automatic moisture content vaporizer Model SE-24, manufactured by Hiranuma Sangyo K.K.

(8) Silicon element quantity:

The quantity of silicon element in the magnetic iron oxide particles is measured by fluorescent X-ray analysis according to JIS-K0119 "General Rules for Fluorescent X-ray Analysis", using a fluorescent X-ray analyzer SYSTEM 3080, manufactured by Rigaku Denki Kogyo K.K.

The magnetic iron oxide particles used in the toner of the present invention may preferably be used in an amount of from 20 parts by weight to 200 parts by weight based on 100 parts by weight of the polymer component as a binder resin.

They may more preferably be used in an mount of from 30 to 150 parts by weight.

The magnetic iron oxide particles may be optionally treated with a silane coupling agent, a titanium coupling agent, a titanate, an aminosilane or an organosilicon compound.

The silane coupling agent used in surface treatment of the magnetic iron oxide particles may include, for example, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane and 1,3-diphenyltetramethyldisiloxane.

The titanium coupling agent may include, for example, isopropoxytitanium triisostearate, isopropoxytitanium dimethacrylate isostearate, isopropoxytitanium tridodecylbenzene sulfonate, isopropoxytitanium trisdioctyl phosphate, isopropoxytitanium tri-N-ethylaminoethyl aminate, titanium bisdioctyl pyrophosphate oxyacetate, titanium bisdioctyl phosphate ethylenedioctyl phosphite, and di-n-butoxy bistriethanolaminatotitanium.

The organosilicon compound may include silicone oils. Silicone oils preferably used are those having a viscosity of from 30 to 1,000 centistokes at 25° C., preferably as exemplified by dimethyl silicone oil, methylphenyl silicone oil, α-methylstyrene modified silicone oil, chlorophenyl silicone oil, and fluorine modified silicone oil.

In the toner for developing electrostatic images according to the present invention, hitherto known pigments or dyes such as carbon black and copper phthalocyanine may be used as colorants.

The toner for developing electrostatic images according to the present invention contains a charge control agent, which is one of features thereof. When the toner is a negatively chargeable toner, there are used negative charge control agents, such as metal complex salts of monoazo dyes and metal complex salts of salicylic acid, an alkylsalicylic acid, a dialkylsalicylic acid or naphthoic acid.

For example, the negative charge control agents may include the following compounds.

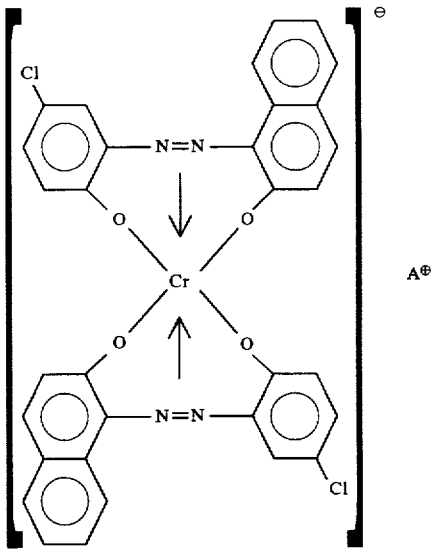

($A^{\oplus}$; $H^{\oplus}$, $Na^{\oplus}$, $K^{\oplus}$, $NH_4^{\oplus}$)

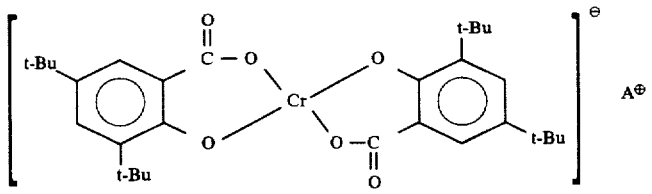

t-Bu: t-butyl group

-continued

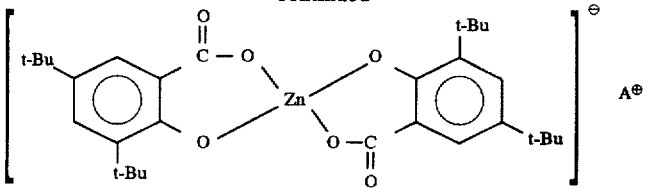

Compounds more effective as negative charge control agents used in combination with the magnetic iron oxide previously described above may include the following three types.

Compound (1)

A monoazo iron complex salt represented by the formula:

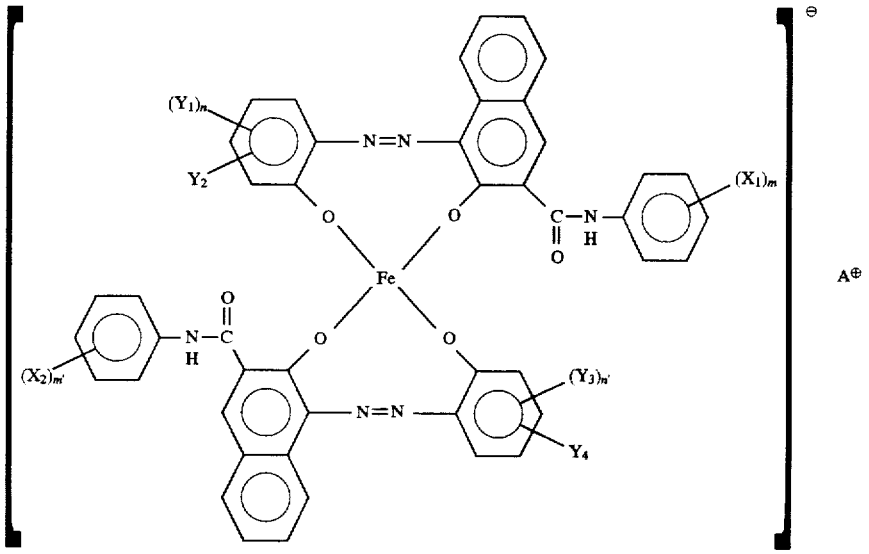

wherein $X_1$ and $X_2$ each represent a hydrogen atom, a lower alkyl group, a lower alkoxyl group, a nitro group or a halogen atom, and m and m' each represent an integer of 1 to 3; $Y_1$ and $Y_3$ each represent a hydrogen atom, an alkyl group having 1 to 18 carbon atoms, an alkenyl group having 2 to 18 carbon atoms, a sulfonamide group, a mesyl group, a sulfonic acid group, a carboxyester group, a hydroxyl group, an alkoxyl group having 1 to 18 carbon atoms, an acetylamino group, a benzoyl group, an amino group or a halogen atom, and n and n' each represent an integer of 1 to 3; $Y_2$ and $Y_4$ each represent a hydrogen atom or a nitro group; provided that the above $X_1$ and $X_2$, m and m', $Y_1$ and $Y_3$, n and n', or $Y_2$ and $Y_4$ may be the same or different; and $A^+$ represents $H^+$, $Na^+$, $K^+$, $NH_4^+$ or mixed ions thereof.

Compound (2)

A compound of an aromatic hydroxycarboxylic acid, aromatic diol or aromatic dicarboxylic acid derivative with an iron atom, represented by the formula:

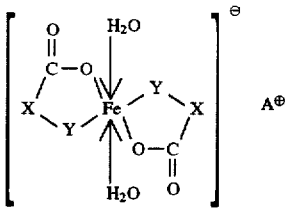

wherein X represents

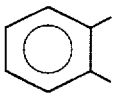

(which may have a substituent as an alkyl group),

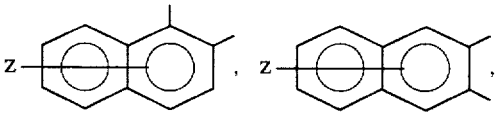

-continued

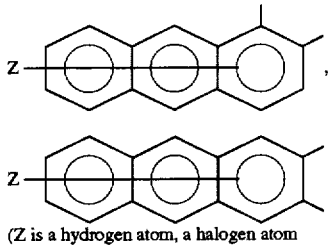

(Z is a hydrogen atom, a halogen atom or a nitro group)

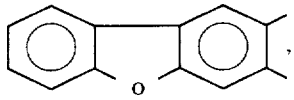

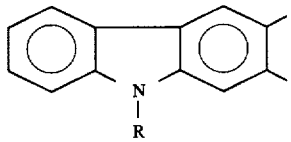

or

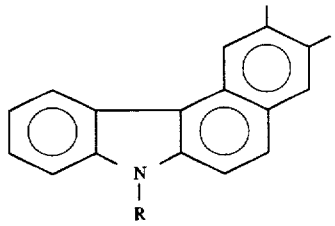

(R is a hydrogen atom or an alkyl or alkenyl group having 1 to 18 carbon atoms), Y represents $$-O- \quad \text{or} \quad -\overset{O}{\overset{\|}{C}}-O-,$$

and $A^+$ represents $H^+$, $Na^+$, $NH_4^+$ or an aliphatic ammonium.

Compound (3)

An N-N'-bisarylurea derivative represented by the formula:

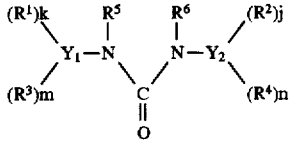

wherein $Y_1$ and $Y_2$ each represent a phenyl group, a naphthyl group or an anthryl group; $R^1$ and $R^2$ each represent a halogen atom, a nitro group, a sulfonic group, a carboxyl group, a carboxylic ester group, a cyano group, a carbonyl group, an alkyl group, an alkoxyl group or an amino group; $R^3$ and $R^4$ each represent a hydrogen atom, an alkyl group, an alkoxyl group, a phenyl group which may be substituted, an aralkyl group which may be substituted or an amino group; $R^5$ and $R^6$ each represent a hydrogen atom or a hydrocarbon group having 1 to 8 carbon atoms; k and j each represent an integer of 0 to 3 (not 0 at the same time); and m and n each represent an integer of 1 or 2; provided that the above $Y_1$ and $Y_2$, $R^1$ and $R^2$, $R^3$ and $R^4$, $R^5$ and $R^6$, k and j, or m and n may be the same or different.

In particular, the monoazo iron complex Compound (4) represented by the following formula is specially preferred.

Compound (4)

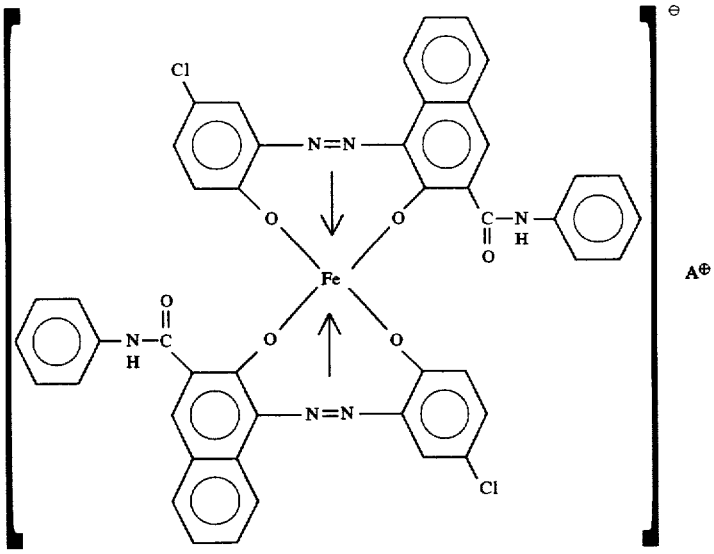

wherein $A^+$ represents $H^+$, $Na^+$, $K^+$, $NH_4^+$ or mixed ions thereof.

It has been confirmed that the use of the above negative charge control agent in combination with the polymer component with adjusted acid values improves image characteristics, in particular, prevents or controls fog.

Positive charge control agents may include Nigrosine and its modified products with a fatty acid metal salt; quaternary ammonium salts such as tributylbenzylammonium 1-hydroxy-4-naphthosulfonate, tetrabutylammonium tetrafluoroborate, and analogues of these, onium salts such as phosphonium salts, and lake pigments of these; triphenylmethane dyes and lake pigments of these (a lake forming agent may include phosphotungstic acid, phosphomolybdic acid, phosphotungstomolybdic acid, tannic acid, lauric acid, gallic acid, ferricyanides and ferrocyanides); metal salts of higher fatty acid; acetylacetone metal complexes; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in a combination of two or more kinds. Of these, Nigrosine type or quaternary ammonium salt type charge control agents may particularly preferably be used.

In view of the charge quantity of the toner, any of these charge control agents may preferably be used in an mount of from 0.1 to 5.0 parts by weight based on 100 parts by weight of the polymer component as the binder resin.

The toner for developing electrostatic images according to the present invention is preferably mixed with an inorganic fine powder or a hydrophobic inorganic fine powder, which may include, for example, fine silica powder, fine titanium oxide powder, and any of these having been made hydrophobic. These may preferably be used alone or in combination.

The fine silica powder may be what is called dry process silica produced by vapor phase oxidation of silicon halides, or what is called wet process silica produced from dry process silica (called fumed silica), water glass or the like, either of which can be used. There is preferred the dry process silica having less silanol groups on the surface and inside and leaving no production residue.

The fine silica powder may preferably be those having been made hydrophobic. It can be made hydrophobic by chemical treatment with an organosilicon compound or the like capable of reacting with or being physically adsorbed by the fine silica powder. As a preferable method, a dry process fine silica powder produced by vapor phase oxidation of a silicon halide may be treated with an organosilicon compound such as silicone oil after the powder has been treated with a silane coupling agent, or at the same time it is treated with a silane coupling agent.

The silane coupling agent used in such hydrophobic treatment may include, for example, hexamethyldisilazane, trimethylsilane,
trimethylchloro-silane, trimethylethoxysilane,
dimethyldichlorosilane, methyltrichlorosilane,
allyldimethylchlorosilane, allylphenyldichlorosilane,
benzyldimethylchlorosilane,
bromomethyldimethylchlorosilane,
α-chloroethyltri-chlorosilane,
β-chloroethyltrichlorosilane,
chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane,
1,3-divinyltetramethyldisiloxane and
1,3-diphenyltetramethyldisiloxane.

The organosilicon compound may include silicone oils. Silicone oils preferably used are those having a viscosity of from 30 to 1,000 centistokes at 25° C., as exemplified by dimethyl silicone oil, methylphenyl silicone oil, α-methylstyrene modified silicone oil, chlorophenyl silicone oil, and fluorine modified silicone oil.

The treatment with silicone oil may be made by a method in which, for example, the fine silica powder treated with a silane coupling agent and the silicone oil are directly mixed by means of a mixing machine such as a Henschel mixer, or the silicone oil is sprayed on the fine silica powder serving as a base. Alternatively, the silicone oil may be dissolved or dispersed in a suitable solvent and thereafter the solution or dispersion may be mixed with the base fine silica powder.

As a preferable treatment for making hydrophobic the fine silica powder used in the present invention, there may also be named a method in which the fine silica powder is treated with dimethyldichlorosilane, subsequently treated with hexamethyldisilazane, and then treated with silicone oil.

Treating the fine silica powder with two or more kinds of silane coupling agents and thereafter with silicone oil as described above is preferred since the hydrophobicity can be effectively increased.

Fine titanium oxide powder on which the hydrophobic treatment made on the fine silica powder and also the silicone oil treatment have been made is also preferable like the treated fine silica powder.

To the toner for developing electrostatic images according to the present invention, other external additives may be optionally added.

They are, for example, fine resin particles or inorganic fine particles that act as a charging auxiliary agent, a conductivity-providing agent, a fluidity-providing agent, an anti-caking agent, a release agent at the time of heat roll fixing, a lubricant, or an abrasive.

The fine resin particles may preferably be those having an average particle diameter of from 0.03 to 1.0 μm. Polymerizable monomers for producing such fine resin particles may include styrene monomers such as styrene, o-methylstyrene, m-methylstyrene, p-methylstyrene, p-methoxystyrene and p-ethylstyrene; acrylic acids such as acrylic acid and methacrylic acid; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; nitriles such as acrylonitrile and methacrylonitrile; and acrylamides such as acrylamide.

These monomers may be polymerized by suspension polymerization, emulsion polymerization or soap-free polymerization, any of which may be used. Fine resin particles obtained by soap-free polymerization are more preferred.

Such fine resin particles are greatly effective for preventing the toner from melt-adhering to drums especially in a contact charging system having a roller, a brush, a blade or the like as a primary charging means.

Other fine particles may include lubricants such as Teflon, zinc stearate and polyvinylidene fluoride (in particular, polyvinylidene fluoride is preferred); abrasives such as cerium oxide, silicon carbide and strontium titanate (in particular, strontium titanate is preferred); fluidity-providing agents such as titanium oxide and aluminum oxide (in particular, hydrophobic one is preferred); anti-caking agents; conductivity-providing agents such as carbon black, zinc oxide, antimony oxide and tin oxide; and white fine particles and black fine particles having the polarity opposite to the charge polarity of the toner particles.

The fine resin particles, inorganic fine particles or hydrophobic inorganic fine particles mixed in the toner particles may preferably be used in an amount of from 0.1 to 5 parts by weight, and more preferably from 0.1 to 3 parts by weight, based on 100 parts by weight of the toner.

The toner for developing electrostatic images according to the present invention can be produced by well mixing the polymer component, the pigment, dye or magnetic material serving as a colorant, the charge control agent and other additives by means of a mixing machine such as a ball mill, thereafter melting, intimate mixing and ink milling the mixture by means of a heat kneader such as a heat roll, a kneader or an extruder, and then cooling the kneaded product to solidify, followed by pulverization and strict classification.

As an other method for obtaining the toner for developing electrostatic images according to the present invention, the toner may be produced by polymerization. Such a polymerization toner is obtained in the following way. The polymerizable monomers, the charge control agent in the present invention, the pigment or dye, the magnetic iron oxide and the polymerization initiator (also optionally the cross-linking agent and other additives) are uniformly dissolved or dispersed to form a monomer composition. Thereafter, this monomer composition or a product obtained by beforehand polymerizing this monomer composition is dispersed in a continuous phase (e.g., water) containing a dispersion stabilizer by means of a suitable stirrer to simultaneously carry out polymerization reaction to obtain toner particles having the desired particle diameters. In this polymerization, where the magnetic iron oxide is used, it may preferably have been made hydrophobic.

The magnetic iron oxide particles containing silicon element as previously described can be produced, for example, in the following manner.

An aqueous ferrous salt reacted solution containing a ferrous hydroxide colloid obtained by reacting an aqueous ferrous salt solution with an aqueous alkali hydroxide solution used in 0.90 to 0.99 equivalent weight on the basis of $Fe_2^+$ present in the aqueous ferrous salt solution, is aerated with an oxygen-containing gas to form magnetite particles. In that course, to either the aqueous alkali hydroxide solution or the aqueous ferrous salt reacted solution containing the ferrous hydroxide colloid, a water-soluble silicate is beforehand added in an amount of 50 to 99% by weight in terms of silicon element, based on the total content (0.4 to 2.0% by weight) of iron element, and the solution is aerated with the oxygen-containing gas while heating at a temperature ranging from 85° to 100° C. to carry out oxidation reaction, whereby magnetic iron oxide particles containing silicon element is made from the ferrous hydroxide colloid. Thereafter, the aqueous alkali hydroxide solution used in at least 1 equivalent weight on the basis of $Fe_2^+$ remaining in the suspension after the oxidation reaction and the remaining water-soluble silicate that is in an amount of 1 to 50% by weight based on the total content (0.4 to 2.0% by weight) of iron element are added while heating at a temperature ranging from 85° to 100° C., to carry out oxidation reaction to form the magnetic iron oxide particles containing silicon element.

Subsequently, when the particles are treated with the aluminum hydroxide, a water-soluble aluminum salt is added to the alkaline suspension in which the magnetic iron oxide particles containing silicon element have been produced, so as to be in an amount of 0.01 to 2.0% by weight in terms of aluminum element, based on the weight of the particles formed. Thereafter, the pH is adjusted in the range of from 6 to 8 and the aluminum is deposited on the magnetic iron oxide particle surfaces in the form of aluminum hydroxide, followed by filtration, washing with water, drying, and then disintegration. Thus, the magnetic iron oxide having aluminum hydroxide is obtained. As a method for adjusting the resulting particles to have smoothness and specific surface area in the preferable ranges, they may preferably be further subjected to compression, shearing and rubbing by using Mix-maller.

The silicic acid compound added to the magnetic iron oxide is exemplified by silicates such as commercially available sodium silicate, and silicic acids such as sol type silicic acid produced by hydrolysis or the like.

The water-soluble aluminum salt added is exemplified by aluminum sulfate.

As the ferrous salt, it is common to use iron sulfate produced as a by-product in the production of titanium sulfate, and iron sulfate formed as a by-product during surface cleaning of steel sheets. It is also possible to use iron chloride.

Figure 5:
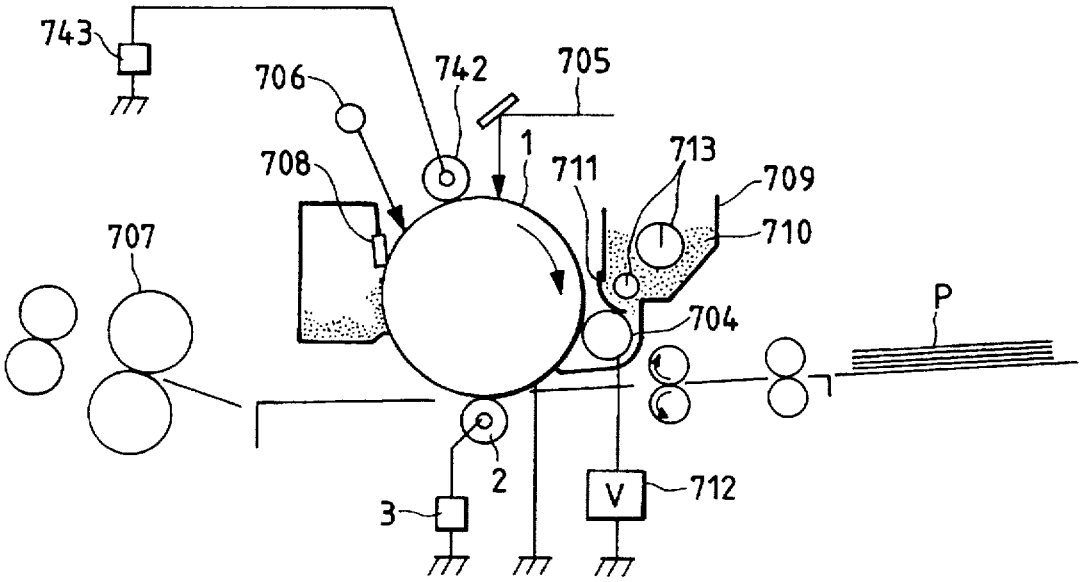
FIG. 5 is a schematic illustration of an example of an image forming apparatus for carrying out the image forming method of the present invention.

An example of the image forming method of the present invention will be described with reference to FIG. 5.

The surface of an electrostatic image bearing member (a photosensitive drum 1) is negatively charged by a primary charging means 742 serving as a contact charging means (e.g., a charging roller, a charging brush or a charging blade) to which a voltage has been applied, and exposed to laser light 705 to form a digital latent image by image scanning. The latent image thus formed is reverse developed using a one-component magnetic toner 709 having negative triboelectric charges which is held in a developing assembly 709 equipped with an elastic blade 711 and a developing sleeve 704 internally provided with a magnet 714. In the developing zone, a conductive substrate of the photosensitive drum is earthed and an AC bias, a pulse bias and/or a DC bias is/are applied to the developing sleeve 704 through a bias applying means 712. A transfer medium P is fed and delivered to the transfer zone, where the transfer medium P is electrostatically charged by a voltage applying means 8 from its back surface (the surface opposite to the photosensitive drum) through a transfer roller means (or a transfer belt means) 2 to which a voltage is applied, so that the developed image (a toner image) on the surface of the photosensitive drum 1 is electrostatically transferred to the transfer medium P by a contact transfer means 2. The transfer medium P separated from the photosensitive drum 1 is subjected to fixing using a heat-pressure roller fixing assembly 707 so that the toner image on the transfer medium P is fixed.

The one-component magnetic toner remaining on the photosensitive drum 1 after the transfer step is removed by the operation of a cleaning means 708 having a cleaning blade. When one-component magnetic toner little remains, the step of cleaning may be omitted. After the cleaning, the residual charges 6n the surface of the photosensitive drum 1 is eliminated by erasure exposure 706, and thus the procedure again starting from the charging step using the primary charging means 742 is repeated.

The photosensitive drum 1 has a photosensitive layer and a conductive substrate, and is rotated in the direction of an arrow. In the developing zone, a developing sleeve 704 formed of a non-magnetic cylinder, which is a toner carrying member, is rotated so as to move in the same direction as the photosensitive drum 11 is rotated. Inside the developing sleeve 704, a multi-polar permanent magnet 704 (magnet roll) serving as a magnetic field generating means is provided in an unrotatable state. The one-component magnetic toner 710 held in the developing assembly 709 is applied on the surface of the non-magnetic cylinder (developing sleeve), and, for example, minus triboelectric charges are imparted to the magnetic toner because of the friction between the surface of the developing sleeve 704 and the magnetic toner particles. An elastic doctor blade 711 is also disposed so as to press the surface of the cylinder. Thus, the thickness of magnetic toner layer is controlled to be small (30 μm to 300 μm) and uniform to form a magnetic toner layer smaller in thickness than the gap between the photosensitive drum 1 and the developing sleeve 704 in the developing zone. The rotational speed of this developing sleeve 704 is regulated so that the peripheral speed of the sleeve can be substantially equal or close to the speed of the peripheral speed of the photosensitive drum. In the developing zone, an AC bias or a pulse bias may be applied to the developing sleeve 704 through a bias means. This AC bias may have a frequency (f) of from 200 to 4,000 Hz and a Vpp of from 500 to 3,000 V.

In the developing zone, the magnetic toner particles are moved to the side of the electrostatic image by the electrostatic force of the surface of the photosensitive drum and the action of the AC bias or pulse bias.

In place of the elastic blade 711, a magnetic doctor blade made of iron may be used.

In FIG. 1, reference numeral 2 denotes a transfer roller, which is basically comprised of a mandrel 2*a* at the center and a conductive elastic layer 2*b* which forms the periphery of the mandrel. The transfer roller 2 is brought into pressure contact with the surface of the photosensitive drum 1 at a given pressure, and is rotated at a speed equal to, or made different from, the peripheral speed of the photosensitive drum 1. A transfer medium is transported between the photosensitive drum 1 and the transfer roller 2 and a bias with a polarity reverse to that of the toner is applied to the transfer roller 2 from a transfer bias applying means 7, so that the toner image on the photosensitive drum 1 is transferred to the surface side of the transfer medium. Subsequently, the transfer medium is transported onto a guide 5.

The conductive elastic layer 2*b* is made of an elastic material having a volume resistivity of $10^6$ to $10^{10}$ Ω·cm, e.g., a polyurethane with a conductive material such as carbon dispersed therein, or an ethylene-propylene-diene type terpolymer (EPDM).

The transfer process may preferably be performed under the conditions of a roller contact pressure of 5 to 500 g/cm and a DC voltage of plus-minus 0.2 to plus-minus 10 kV.

Figure 2:
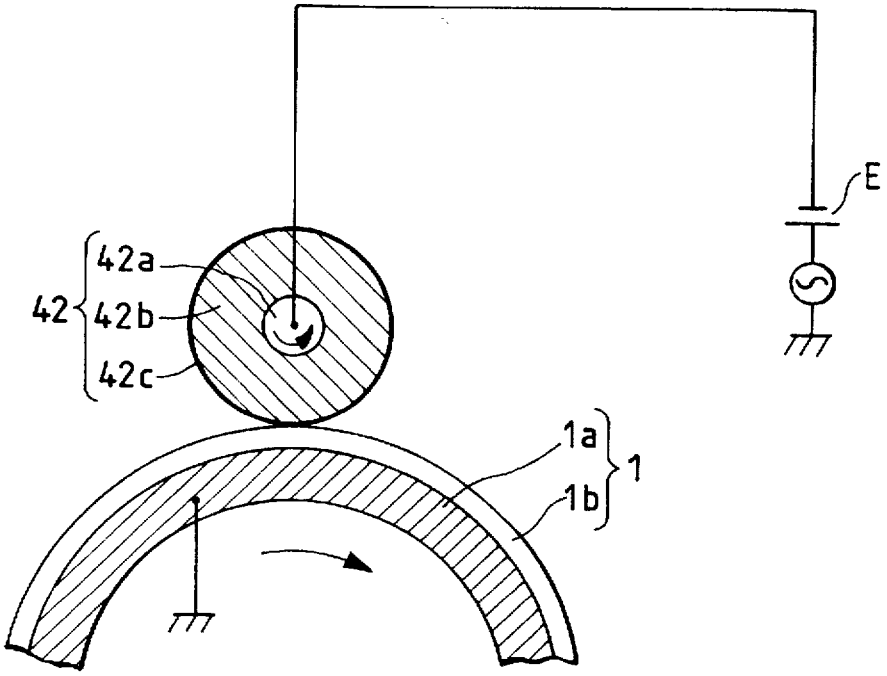
FIG. 2 is a schematic illustration of a charging roller.

In FIG. 2, reference numeral 1 denotes a rotating drum type electrostatic image bearing member (hereinafter "photosensitive drum"). The photosensitive drum 1 is formed of layers basically comprised of a conductive substrate layer 1*a* made of aluminum or the like and a photoconductive layer 1*b* formed on its periphery, and is clockwise rotated as viewed in the drawing, at a given peripheral speed (process speed).

Reference numeral 42 denotes a charging roller, which is basically comprised of a mandrel 42*a* at the center and a conductive elastic layer 42*a* that forms the periphery of the former. The charging roller 42 is brought into pressure contact with the surface of the photosensitive drum 1 at la given pressure, and is rotated following the rotation of the photosensitive drum 1. Application of a bias to the charging roller 42 charges the surface of the photosensitive drum 1 to a given polarity and potential. Imagewise exposure subsequently carried out gives formation of electrostatic latent images. The electrostatic latent images are developed by a developing means and successively converted into visible images as toner images.

The charging process may preferably be performed under the conditions of a roller contact pressure of 5 to 500 g/cm when the charging roller is used; an AC voltage of 0.5 to 5 kVpp, an AC frequency of 50 to 5 kHz and a DC voltage of plus-minus 0.2 to plus-minus 1.5 kV when an AC voltage is superimposed on a DC voltage; and a DC voltage of from plus-minus 0.2 to plus-minus 5 kV when a DC voltage is applied.

The charging roller may preferably be made of a conductive rubber, and a release coat may be provided on its surface. The release coat may be formed of nylon resin, PVDF (polyvinylidene fluoride) or PVDC (polyvinylidene chloride), any of which can be used.

In the image forming method according to the present invention, the method may preferably comprise the steps of forming, on a toner carrying member installed to leave a given gap between the toner carrying member and an electrostatic latent image bearing member, a magnetic toner thin layer not coming into contact with the electrostatic latent image bearing member, and developing an electrostatic latent image on the electrostatic latent image bearing member by the use of the magnetic toner while applying an alternating electric field between the toner carrying member and the electrostatic latent image bearing member, wherein;

the magnetic toner thin layer formed on the toner carrying member has a coat weight set to satisfy:

$$w/\rho=0.5 \text{ to } 1.4$$

where w is a toner coat weight (mg) per 1 $cm^2$ of the surface of the toner carrying member, and ρ is a toner true density ($g/cm^3$); and the peripheral speed of the toner carrying member at the developing zone is 1.05 to 2.0 times the peripheral speed of the electrostatic latent image bearing member.

The charging roller may also be a contact charging means such as a charging blade or a charging brush.

Constituting the polymer component in the composition of the toner in the manner previously described makes it possible to improve low-temperature fixing performance and anti-offset properties. Also, setting the quantity of the toner fed on the toner carrying member so as to be as small as w/ρ=0.5 to 1.4 and setting the peripheral speed of the toner carrying member at the developing zone so as to be as high as 1.05 to 2.0 times the peripheral speed of the electrostatic latent image bearing member make it possible to obtain a toner coat layer less affected by environmental factors such as temperature and humidity and having an always stable, high charge quantity and, also in long-term running, to obtain high-quality images free of fog and having a high image density.

Also when the constitution of the present invention is applied in high-speed processing, there occurs little deterioration due to melt adhesion of toner onto the toner carrying member and electrostatic latent image bearing member or little deterioration of the toner itself, and hence an always stable running performance can be promised.

The reason why such advantages can be obtained is that, since the polymer component in the resin composition is constituted in the manner previously described, the properties tough to mechanical load and of hardly causing adhesion in low-temperature ranges can be obtained, and hence, even under severe service conditions such that the toner carrying member is rotated at a high speed in the state the toner is fed in a small quantity, there occurs little deterioration due to melt adhesion of toner onto the toner carrying member and electrostatic latent image bearing member or little deterioration of the toner itself. Hence, it has become possible to set the quantity of the toner fed on the toner carrying member so as to be as small as w/ρ=0.5 to 1.4 and also set the peripheral speed of the toner carrying member at the developing zone so as to be as high as 1.05 to 2.0 times the peripheral speed of the electrostatic latent image bearing member, and, under such conditions, it has become possible to feed a toner having a high charge quantity, to latent images in a sufficient quantity.

If the relationship between toner coat weight per unit area of the magnetic toner thin layer formed on the surface of the toner carrying member and toner true density, w/ρ, is less than 0.5, the quantity of the toner fed on latent images may decrease to cause a decrease in image density when a large quantity of toner is required for development over a broad area as in the case of solid black. In such a case, adhesion of toner to the toner carrying member may occur, which is not desirable. On the other hand, if it exceeds 1.4, it becomes difficult for the toner to be well triboelectrically charged, resulting in a broad distribution of toner charge quantity to tend to cause fog.

As to the toner true density, the data obtained using a dry process automatic densitometer AccuPyc 1330, manufactured by Shimadzu Corporation, are used.

If the the peripheral speed of the toner carrying member is less than 1.05 times the peripheral speed of the electrostatic latent image bearing member, the quantity of the toner fed on latent images may decrease to cause a decrease in image density when a large quantity of toner is required for development over a broad area as in the case of solid black. If it exceeds 2.0 times, in such a case there may be caused deterioration of toner or adhesion of toner to the toner carrying member, which is not desirable.

Figure 6:
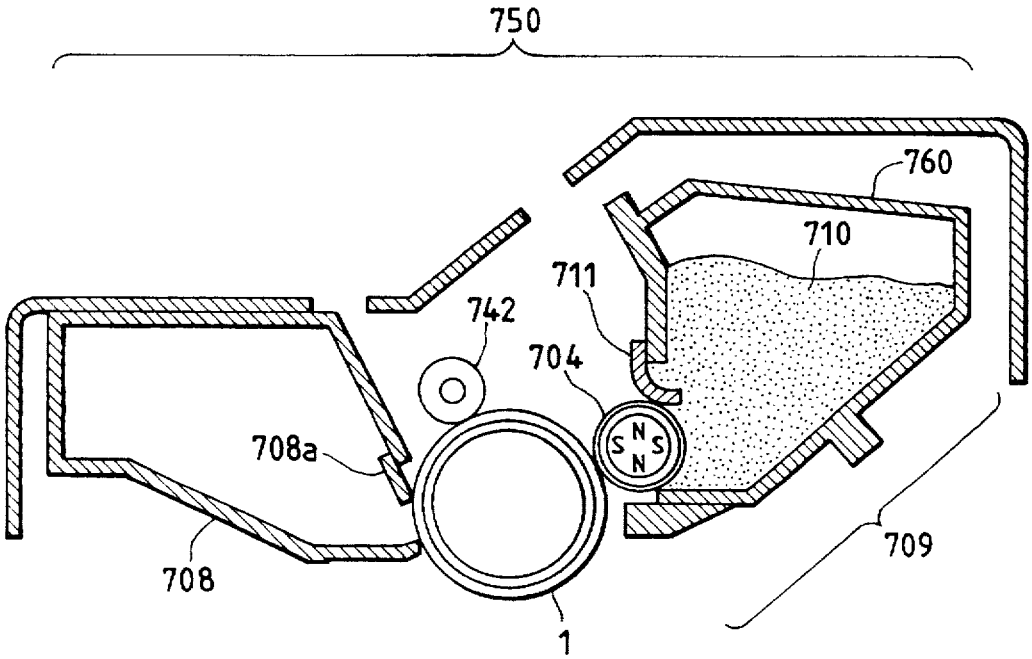
FIG. 6 is a schematic illustration of an example of the process cartridge of the present invention.

FIG. 6 schematically illustrates an example of a process cartridge. The process cartridge has at least a developing means and an electrostatic image bearing member which are held into one unit as a cartridge, and the process cartridge is so set up as to be detachable from the main body of an image forming apparatus (e.g., a copying machine or a laser beam printer).

In this example, the process cartridge has a developing means 709, a drum type electrostatic image bearing member (a photosensitive drum) 1, a cleaner 708 having a cleaning blade 708*a*, and a primary charging means (a contact charging roller, a contact charging brush or a contact charging blade) 742, which are held into one unit.

In this example, developing means 709 has an elastic blade 711 and a toner container 760 holding a magnetic toner 710. When development is carried out using the magnetic toner, a given electric field is formed between the photosensitive drum 1 and a developing sleeve 704 by a bias applied from a bias applying means. In order to preferably carry out the development, the distance between the photosensitive drum 1 and the developing sleeve 704 is very important.

The present invention will be further described below by giving Examples. The present invention is by no means limited to these.

RESIN COMPOSITION, PREPARATION EXAMPLE 1

Synthesis of low-molecular weight polymer (L-1)

Into a four-necked flask, 300 parts by weight of xylene was charged, and the inside of the flask was replaced by nitrogen with stirring. Thereafter the temperature was raised to carry out reflux.

Under this reflux, a solution of mixture of 75 parts by weight of styrene, 18 parts by weight of n-butyl acrylate, 7 parts by weight of monobutyl maleate and 2 parts by weight of di-tert-butyl peroxide were dropwise added over a period of 4 hours, and thereafter the reaction mixture was maintained for 2 hours, where the polymerization was completed to obtain a low-molecular weight polymer (L-1) solution.

A portion of this polymer solution was sampled, and was dried under reduced pressure. GPC and measurement of glass transition temperature (Tg) of the low-molecular weight polymer (L-1) obtained were carried out to reveal that its weight average molecular weight (Mw) was 9,600, number average molecular weight (Mn) was 6,000, peak molecular weight (PMw) was 8,500, Tg was 62° C. and acid value was 25.

In this polymerization, the conversion of polymer was 97%.

Synthesis of high-molecular weight polymer (H-1)

Into a four-necked flask, 180 parts by weight of deaerated water and 20 parts by weight of an aqueous solution of 2% by weight of polyvinyl alcohol were charged, and thereafter a solution of mixture of 70 parts by weight of styrene, 25 parts by weight of n-butyl acrylate, 5 parts by weight of monobutyl maleate, 0.005 part by weight of divinyl benzene and 0.1 part by weight of 2,2-bis(4,4-di-tert-butyl peroxycyclohexyl)propane (half-life: 10 hours; temperature: 92° C.) was added, followed by stirring to form a suspension.

The inside of the flask was thoroughly replaced by nitrogen, and thereafter the temperature was raised to 85° C. to initiate polymerization. The reaction mixture was maintained at the same temperature for 24 hours, and thereafter 0.1 part by weight of benzoyl peroxide (half-life: 10 hours; temperature: 72° C.) was further added. The reaction mixture was further maintained for 12 hours, where the polymerization was completed to obtain a high-molecular weight polymer (H-1) suspension.

Into the suspension formed after completion of the reaction, an aqueous NaOH solution was charged in a 6-fold equivalent weight of the acid value (AV: 7.8) of the high-molecular weight polymer (H-1) obtained, followed by stirring for 2 hours.

The high-molecular weight polymer (H-1) was filtered, washed with water and dried, and thereafter analyzed to reveal that Mw was 1,800,000, PMw was 1,200,000, Tg was 62° C. and acid value was 6.

Preparation of resin composition

Into a four-necked flask, 100 parts by weight of xylene, 25 parts by weight of the above high-molecular weight polymer (H-1) and 4 parts by weight of low-molecular weight polypropylene wax (Mw: 6,000) were charged, and the temperature was raised, followed by stirring under reflux to carry out preliminary dissolution. In this state, the reaction mixture was maintained for 12 hours and thus a uniform preliminary solution (Y-1) formed of the high-molecular weight polymer (H-1) and the low-molecular weight polypropylene wax was obtained.

A portion of this preliminary solution was sampled, and was dried under reduced pressure. Glass transition temperature of the solid matter obtained was measured to find that it was 61° C.

Meanwhile, 300 parts by weight of a homogeneous solution of the low-molecular weight polymer (L-1) was charged into another container to carry out reflux.

The preliminary solution (Y-1) and low-molecular weight polymer (L-1) were mixed under reflux, followed by removal of the solvent. The resulting resin was cooled to solidify, followed by pulverization to obtain a resin composition (I) for toner.

The resin composition (I) was analyzed to reveal that PMw was 1,100,000, the area ratio in molecular weight distribution measured by GPC of the resin composition with a molecular weight of 1,000,000 or more was 9.2%, Tg was 62.5° C., and THF-insoluble matter (except the low-molecular weight polypropylene wax) was in a content of 2.1% by weight.

RESIN COMPOSITION, PREPARATION EXAMPLES 2, 3 & 7

In the same manner as in Resin Composition Preparation Example 1 but changing the amount of monobutyl maleate, styrene, n-butyl acrylate each and the amount of the initiator, low-molecular weight polymers L-2 to L-4 were obtained, which were then each blended with a given amount of the high-molecular weight polymer H-1 to obtain resin compositions II, III and VII. Their molecular weight distribution and so forth were measured to obtain the results as shown in Table 1.

RESIN COMPOSITION, PREPARATION EXAMPLES 4 & 5

In the same manner as in Resin Composition Preparation Example 1 but changing the amount of monobutyl maleate, styrene, n-butyl acrylate each and the amount of the initiator, high-molecular weight polymers H-2 and H-3 were obtained, which were then each blended with a given amount of the low-molecular weight polymer L-1 to obtain resin compositions IV and V. Their molecular weight distribution and so oh were measured to obtain the results as shown in Table 1.

RESIN COMPOSITION, PREPARATION EXAMPLE 6

Synthesis of high-molecular weight polymer (H-4)

Into a four-necked flask, 85 parts by weight of styrene and 15 parts by weight of butyl methacrylate were charged, followed by addition of xylene to carry out solution polymerization in the presence of solvent to obtain a high-molecular weight polymer (H-4). The high-molecular weight polymer obtained were analyzed to obtain the results as shown in Table 1.

Preparation of resin composition

A resin composition VI was obtained in the same manner as in Preparation Example 1 except that the high-molecular weight polymer was replaced with the above H-4. Its molecular weight distribution and so forth were measured to obtain the results as shown in Table 1.

TABLE 1

Resin Composition Preparation Examples

| | Resin composition | | Low-molecular weight polymer Mw | PMw | Tg (°C.) | $A'_{VL}$ (mgKOH/g) | Low/high molecular weight polymer ratio ($W_L/W_H$) | | High-molecular weight polymer Mw (×10⁴) | PMw (×10⁴) | Tg (°C.) | $A'_{VH}$ (mgKOH/g) | Molecular wt. ≧ 1 × 10⁶ GPC area ratio (%) | THF-insoluble matter (%) |
|---|---|---|---|---|---|---|---|---|---|---|---|---|---|---|
| Preparation Example: | | | | | | | | | | | | | | |
| 1 | I | L-1 | 9,600 | 8,500 | 62 | 25 | 75/25 | H-1 | 180 | 120 | 62 | 6 | 9.2 | 2.1 |
| 2 | II | L-2 | 5,000 | 3,700 | 64 | 26.3 | 50/50 | H-1 | 180 | 120 | 62 | 6 | 16.4 | 3.5 |
| 3 | III | L-3 | 30,000 | 28,000 | 63.2 | 33.8 | 90/10 | H-1 | 180 | 120 | 62 | 6 | 4.0 | 1.0 |
| 4 | IV | L-1 | 9,600 | 8,500 | 62 | 25 | 70/30 | H-2 | 120 | 82 | 61.5 | 8.4 | 3.0 | 1.1 |
| 5 | V | L-1 | 9,600 | 8,500 | 62 | 25 | 70/30 | H-3 | 120 | 83 | 61 | 0.6 | 4.0 | 0.9 |
| 6 | VI | L-1 | 9,600 | 8,500 | 62 | 25 | 50/50 | H-4 | 90 | 50 | 64 | 2.9 | 0.2 | 0.1 |
| 7 | VII | L-4 | 9,500 | 8,400 | 53 | 25 | 75/25 | H-1 | 180 | 120 | 62 | 6 | 9.2 | 2.0 |

RESIN COMPOSITION, COMPARATIVE PREPARATION EXAMPLES 1 TO 5

Resin compositions i to v having the physical properties as shown in Table 2 were obtained in the manner similar to Example 1. Their molecular weight distribution and so forth were measured to obtain the results as shown in Table 2.

TABLE 2

Resin Composition Comparative Preparation Examples

| | Resin composition | Low-molecular weight polymer | | | | | Low/high molecular weight polymer ratio ($W_L/W_H$) | High-molecular weight polymer | | | | | Molecular wt. ≧ $1 \times 10^6$ GPC area ratio (%) | THF-insoluble matter (%) |
|---|---|---|---|---|---|---|---|---|---|---|---|---|---|---|
| | | | Mw | PMw | Tg (°C.) | $A'_V$ (mgKOH/g) | | | Mw ($\times 10^4$) | PMw ($\times 10^4$) | Tg (°C.) | $A'_V$ (mgKOH/g) | | |
| | | | | | | | Comparative Preparation Example: | | | | | | | |
| 1 | i | L-5 | 9,700 | 8,500 | 62 | 16.5 | 75/25 | H-1 | 180 | 120 | 62 | 6 | 9.2 | 2 |
| 2 | ii | L-6 | 9,800 | 8,600 | 62 | 0 | 75/25 | H-1 | 180 | 120 | 62 | 6 | 9.2 | 2.2 |
| 3 | iii | L-7 | 9,700 | 8,500 | 62 | 41.2 | 75/25 | H-1 | 180 | 120 | 62 | 6 | 9.1 | 2.1 |
| 4 | iv | L-8 | 9,600 | 8,500 | 62 | 25 | 75/25 | H-5 | 180 | 125 | 61 | 12.4 | 9.3 | 3.0 |
| 5 | v | L-9 | 40,000 | 37,000 | 63 | 23 | 85/15 | H-1 | 180 | 125 | 62 | 6 | 3.1 | 0.4 |

Examples for preparing the magnetic iron oxide particles are shown below.

MAGNETIC IRON OXIDE PARTICLES. PREPARATION EXAMPLE 1

In an aqueous ferrous sulfate solution, an aqueous sodium hydroxide in 0.95 equivalent weight on the basis of $Fe_2^+$ was mixed, and then an aqueous ferrous sulfate solution containing $Fe(OH)_2$ was formed.

Thereafter, sodium silicate was added in an amount of 1.0% in terms of silicon element, on the basis of iron element. Subsequently, the aqueous ferrous sulfate solution containing $Fe(OH)_2$ was aerated at a temperature of 90° C. to cause oxidation reaction to form a suspension of magnetic iron oxide particles containing silicon element.

To this suspension, an aqueous sodium hydroxide solution with sodium silicate dissolved therein in an amount of 0.1% (in terms of silicon element, on the basis of iron element) was further added in 1.05 equivalent weight on the basis of remaining $Fe_2^+$, and oxidation reaction was carried out while heating at a temperature of 90° C., to form magnetic iron oxide particles containing silicon element.

The magnetic iron oxide particles thus formed were washed, filtered and dried by conventional methods. Next, magnetic iron oxide particles agglomerated were disintegrated (agglomerate powdering treatment by using Mixmailer) to obtain magnetic iron oxide particles (a) having the properties as shown in Table 3. The average particle diameter thereof was 0.21 μm.

MAGNETIC IRON OXIDE PARTICLES. PREPARATION EXAMPLES 2 AND 3

Magnetic iron oxide particles (b) and (c) of Preparation Examples 2 and 3, respectively, were obtained in the same manner as in Preparation Example 1 but changing the amount of silicon element. Their properties were as shown in Tables 3 and 4.

MAGNETIC IRON OXIDE PARTICLES. PREPARATION EXAMPLES 4 TO 7

Magnetic iron oxide particles were prepared in the same manner as in Preparation Example 1 but adding aluminum sulfate in a given amount before the filtering step after the reaction. The pH was adjusted in the range of 6 to 8 and the aluminum was deposited in the form of aluminum hydroxide to make surface treatment of the magnetic iron oxide particles. Thus, magnetic iron oxide particles (d) to (g) of Preparation Examples 4 to 7, respectively, were obtained. Their properties were as shown in Tables 3 and 4.

MAGNETIC IRON OXIDE PARTICLES. PREPARATION EXAMPLES 8 & 9

Magnetic iron oxide particles (h) and (i) of Preparation Examples 8 and 9, respectively, were obtained in the same manner as in Preparation Example 1 but adding the total content of silicon in a given amount at the first-stage reaction and changing the adjustment of pH. Their properties were as shown in Tables 3 and 4.

MAGNETIC IRON OXIDE PARTICLES. PREPARATION EXAMPLES 10 & 11

Magnetic iron oxide particles (j) and (k) of Preparation Examples 10 and 11, respectively, were obtained in the same manner as in Preparation Example 1 but adding the total content of silicon in a given amount at the first-stage reaction, mixing the aqueous sodium hydroxide in an amount more than 1 equivalent weight on the basis of $Fe_2^+$ and changing the adjustment of pH. Their properties were as shown in Tables 3 and 4.

MAGNETIC IRON OXIDE PARTICLES. PREPARATION EXAMPLES 12 & 13

Magnetic iron oxide particles (l) and (m) of Preparation Examples 10 and 11, respectively, were obtained in the same manner as in Preparation Example 1 but adding the total content of silicon in a given amount at the first-stage reaction, mixing the aqueous sodium hydroxide in an amount more than 1 equivalent weight on the basis of $Fe_2^+$ and changing the adjustment of pH. Their properties were as shown in Tables 3 and 4.

TABLE 3

Properties of Magnetic Iron Oxide Particles

| | Magnetic iron oxide | Silicon content (%) | Surface $SiO_2$ (%) | Smoothness | Bulk density ($g/cm^3$) | BET specific surface area ($m^2/g$) | Aluminum content (%) |
|---|---|---|---|---|---|---|---|
| Preparation Example: | | | | | | | |
| 1 | (a) | 1.09 | 0.19 | 0.53 | 1.10 | 10.0 | — |
| 2 | (b) | 1.82 | 0.50 | 0.41 | 1.12 | 14.6 | — |
| 3 | (c) | 0.48 | 0.08 | 0.65 | 1.00 | 8.7 | — |
| 4 | (d) | 0.80 | 0.15 | 0.60 | 1.10 | 9.1 | 0.25 |
| 5 | (e) | 0.80 | 0.15 | 0.59 | 1.11 | 9.3 | 0.05 |
| 6 | (f) | 0.80 | 0.15 | 0.52 | 1.12 | 10.5 | 1.52 |
| 7 | (g) | 0.80 | 0.15 | 0.50 | 1.08 | 11.0 | 2.20 |
| 8 | (h) | 1.68 | 0.80 | 0.29 | 0.75 | 18.9 | — |
| 9 | (i) | 0.87 | 0.48 | 0.31 | 0.81 | 14.8 | — |
| 10 | (j) | 1.68 | 1.12 | 0.30 | 0.65 | 18.3 | — |
| 11 | (k) | 1.50 | 1.01 | 0.28 | 0.80 | 12.0 | — |
| 12 | (l) | 0.25 | 0.005 | 0.81 | 1.06 | 6.8 | — |
| 13 | (m) | 2.40 | 1.30 | 0.28 | 0.60 | 20.4 | — |

TABLE 4

Properties of Magnetic Iron Oxide Particles

| | Magnetic iron oxide | Total pore volume (ml/g) | Specific surface area: Micropores ($m^2/g$) | Specific surface area: Mesopores ($m^2/g$) | (1) | Moisture content: 23.5° C./65% RH (%) | Moisture content: 32.5° C./85% RH (%) |
|---|---|---|---|---|---|---|---|
| Preparation Example: | | | | | | | |
| 1 | (a) | $1.1 \times 10^{-2}$ | 4.8 | 5.3 | No | 0.92 | 1.24 |
| 2 | (b) | $1.5 \times 10^{-2}$ | 7.2 | 7.3 | No | 1.05 | 1.56 |
| 3 | (c) | $9.2 \times 10^{-3}$ | 3.7 | 3.9 | No | 0.54 | 0.72 |

TABLE 4-continued

Properties of Magnetic Iron Oxide Particles

| | Magnetic iron oxide | Total pore volume (ml/g) | Specific surface area: Micropores ($m^2/g$) | Specific surface area: Mesopores ($m^2/g$) | (1) | Moisture content: 23.5° C./65% RH (%) | Moisture content: 32.5° C./85% RH (%) |
|---|---|---|---|---|---|---|---|
| 4 | (d) | $1.1 \times 10^{-2}$ | 5.0 | 5.3 | No | 0.89 | 1.03 |
| 5 | (e) | $1.3 \times 10^{-2}$ | 5.2 | 6.2 | No | 0.89 | 1.01 |
| 6 | (f) | $1.2 \times 10^{-2}$ | 4.9 | 5.9 | No | 0.98 | 1.23 |
| 7 | (g) | $1.2 \times 10^{-2}$ | 5.2 | 5.8 | No | 1.05 | 1.37 |
| 8 | (h) | $1.9 \times 10^{-2}$ | 9.8 | 9.9 | Yes | 1.12 | 1.63 |
| 9 | (i) | $1.5 \times 10^{-2}$ | 7.8 | 7.2 | Yes | 1.03 | 1.72 |
| 10 | (j) | $1.9 \times 10^{-2}$ | 9.0 | 9.1 | Yes | 1.12 | 1.75 |
| 11 | (k) | $1.3 \times 10^{-2}$ | 6.0 | 5.9 | Yes | 0.92 | 1.53 |
| 12 | (l) | $6.9 \times 10^{-3}$ | 3.2 | 3.6 | No | 0.37 | 0.53 |
| 13 | (m) | $2.2 \times 10^{-2}$ | 11.3 | 9.3 | Yes | 1.17 | 1.89 |

(1): Presence of hysteresis of adsorption-desorption isotherms

EXAMPLE 1

(by weight)

Resin composition (I) 100 parts

Magnetic iron oxide (a) 100 parts

Negative charge control agent (compound represented by the following formula) 2 parts

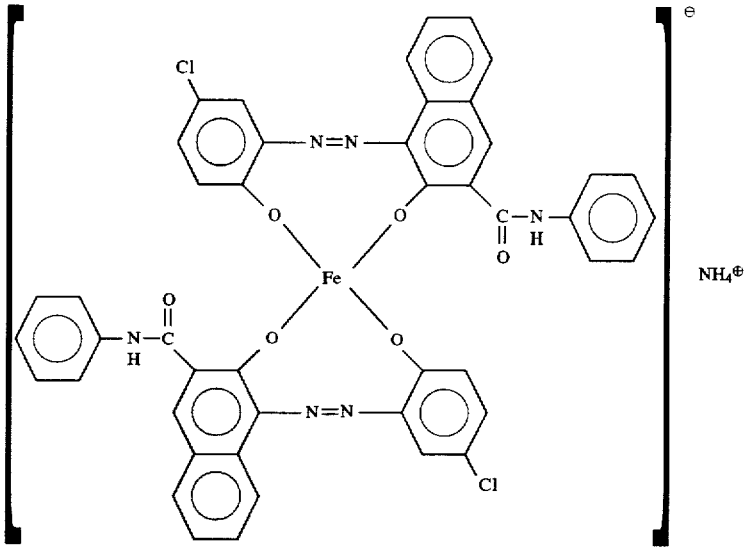

Figure 4:
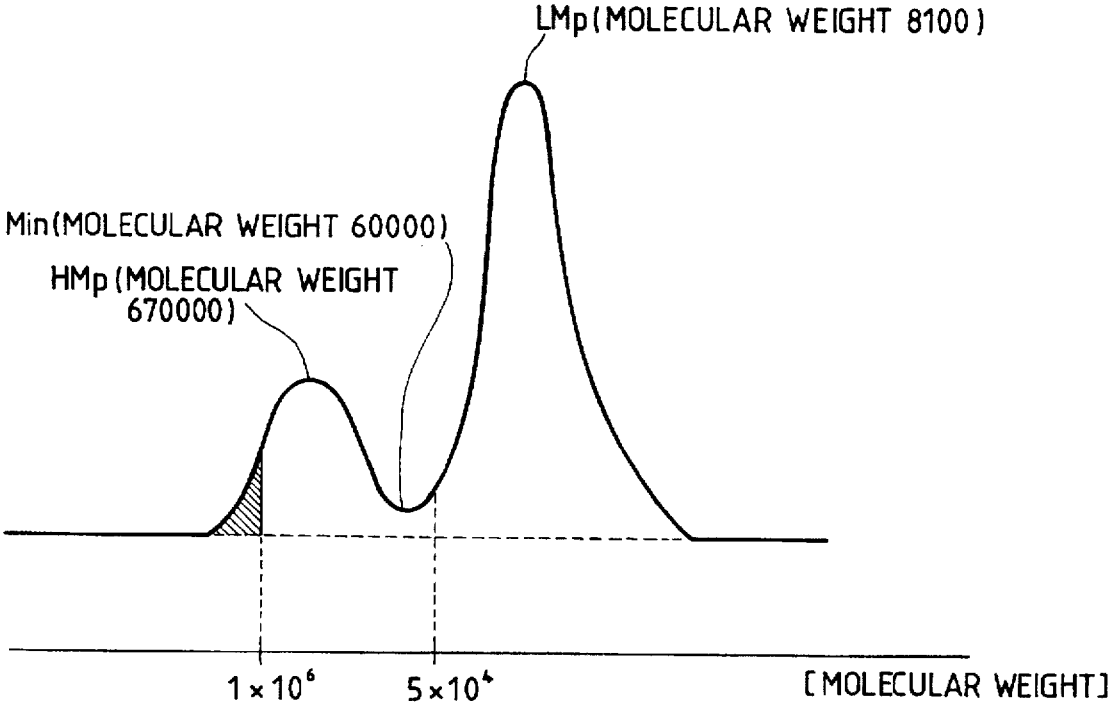
FIG. 4 shows a GPC chart of the polymer component.

A mixture of the above materials was melt-kneaded using a twin-screw extruder heated to 140° C. The resulting kneaded product was cooled, and then crushed using a hammer mill. Thereafter the crushed product was finely pulverized using a jet mill. The resulting finely pulverized product was classified using a fixed wall type air classifier to produce a classified powder. The resulting classified powder was further put in a multi-division Classifier utilizing the Coanda effect (Elbow Jet Classifier, manufactured by Nittetsu Kogyo Co.) to strictly classify and remove ultrafine powder and coarse powder at the same time. Thus, a negatively chargeable magnetic toner with a weight average particle diameter (D4) of 6.7 μm (content of magnetic toner particles with particle diameters not smaller than 12.7 μm: 0.2%) was obtained. Physical properties of the toner thus obtained were as shown in Tables 5 and 6, and a chart of its GPC chromatogram was as shown in FIG. 4.

Next, 100 parts by weight of the magnetic toner thus obtained, 1.2 part by weight of hydrophobic fine silica powder (BET specific surface area: 300 $m^2/g$) having been treated with dimethyldichlorosilane, thereafter treated with hexamethyldisilazane and then treated with dimethylsilicone oil and 0.08 part by weight of fine styrene-acrylic particles (average particle diameter: 0.05 μm) obtained by soap-free polymerization were blended using a Henschel mixer to produce a magnetic toner (Toner A) having an external additive.

EXAMPLES 2 TO 7, COMPARATIVE EXAMPLES 1 TO 5

Magnetic toners (Toners B to G and Toners T to X) having external additives were obtained in the same manner as in Example 1 but replacing the resin composition I of Example 1 with resin compositions II to VII and (i) to (v), respectively. Physical properties of the toners thus obtained were as shown in Tables 5 and 6.

TABLE 5

| | | GPC molecular weight distribution | | | | | | |
|---|---|---|---|---|---|---|---|---|
| | Toner | Low-molecular side peak value LMp | High-molecular side peak value HMp ($\times 10^4$) | Minimum value Min ($\times 10^4$) | Molecular wt. ≧ $1 \times 10^6$ area ratio (%) | THF-insoluble matter in polymer (wt. %) | (1) | (2) |
| Example: | | | | | | | | |
| 1 | A | 8,100 | 67 | 6 | 5.1 | 0.9 | I | a |
| 2 | B | 3,600 | 62 | 4.5 | 9.2 | 1.4 | II | a |
| 3 | C | 26,000 | 68 | 9 | 3.0 | 0.4 | III | a |
| 4 | D | 8,100 | 41 | 5 | 1.9 | 0.3 | IV | a |
| 5 | E | 8,100 | 42 | 5 | 2.0 | 0.3 | V | a |
| 6 | F | 8,100 | 27 | 3 | 10.3 | 4.4 | VI | a |
| 7 | G | 8,000 | 67 | 5 | 5.0 | 0.8 | VII | a |
| Comparative Example: | | | | | | | | |
| 1 | T | 8,200 | 67 | 6 | 5.0 | 0.9 | i | a |
| 2 | U | 8,200 | 67 | 6 | 5.1 | 0.8 | ii | a |
| 3 | V | 8,200 | 67 | 6 | 5.0 | 0.9 | iii | a |
| 4 | W | 8,100 | 69 | 6 | 5.2 | 1.1 | iv | a |
| 5 | X | 32,000 | 73 | 12 | 2.0 | 0.7 | v | a |

(1): Resin composition
(2): Magnetic iron oxide particles

TABLE 6

Physical Properties of Toners (Acid Value, Total Acid Value)

| | $A_{VL}$ (mgKoH/g) | $A_{VH}$ (mgKOH/g) | $A_{VL}-A_{VH}$ | $A_{VL} \times W_L/W_L + W_H$ | $A_{VL} \times W_L/W_L + W_H$ | $1/W_L + W_H$ $(A_{VL}W_L + A_{VH}W_H)$ | Acid value/ total acid value ratio |
|---|---|---|---|---|---|---|---|
| Example: | | | | | | | |
| 1 | 23 | 7 | 16 | 17.25 | 1.75 | 19 | 0.44 |
| 2 | 21 | 7 | 14 | 10.5 | 3.5 | 14 | 0.58 |
| 3 | 32.5 | 7 | 25.5 | 29.25 | 0.7 | 29.95 | 0.50 |
| 4 | 23 | 9 | 14 | 16.1 | 2.7 | 18.8 | 0.49 |
| 5 | 23 | 0.7 | 22.3 | 16.1 | 0.21 | 16.31 | 0.53 |
| 6 | 23 | 3.5 | 19.5 | 11.5 | 1.75 | 13.25 | 0.63 |
| 7 | 23 | 7 | 16 | 17.25 | 1.75 | 19 | 0.54 |
| Comparative Example: | | | | | | | |
| 1 | 16 | 7 | 9 | 12 | 1.75 | 13.75 | 0.49 |
| 2 | 0.7 | 7 | −6.3 | 0.52 | 1.75 | 2.27 | 0.82 |
| 3 | 40 | 7 | 33 | 30 | 1.75 | 31.75 | 0.39 |
| 4 | 23 | 13 | 10 | 17.25 | 3.25 | 20.5 | 0.61 |
| 5 | 21 | 7 | 14 | 17.85 | 1.05 | 18.9 | 0.47 |

EXAMPLES 8 TO 19

Magnetic toners (Toners H to S) having external additives were obtained in the same manner as in Example 1 but replacing the magnetic iron oxide (a) of Example 1 with magnetic iron oxide (b) to (m), respectively.

Values of physical properties (GPC, molecular weight distribution, THF-insoluble matter, acid value, and acid value/total acid value) were substantially the same as those of Toner A.

EXAMPLE 20

Toner A2 was obtained in the same manner as in Example 1 but replacing the negative charge control agent with 0.6 part by weight of the following chromium complex.

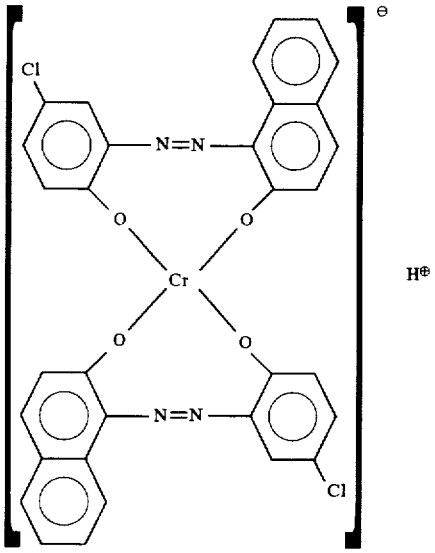

Image Reproduction Test

The above magnetic toners were each put in the process cartridge, and image reproduction was tested to make evaluation, using a modified machine of a laser beam printer LBP-8II (employing an OPC photosensitive drum) of 8 sheets/minute, manufactured by Canon Inc., which was modified to a printing speed of 20 sheets/minute and also incorporated with the transfer assembly as shown in FIG. 1. In this test, the processing speed was 106 mm/sec.

The transfer roller, which had a surface rubber hardness of 27° and was set to operate at a transfer current of 1 μA, a transfer voltage of +2,000 V and a contact pressure of 50 g/cm, was used. The conductive layer of the transfer roller was formed of EPDM (ethylene-propylene-diene-methylene rubber) with conductive carbon dispersed therein and had a volume resistivity of $10^8$ Ω·cm.

The charging roller as shown in FIG. 2 was set in the process cartridge to carry out primary charging. The charging roller 42 had an outer diameter of 12 mm. EPDM was used in the conductive rubber layer **42*b*, and a 10 μm thick nylon resin in the surface layer 42*c*. The charging roller 42 had a hardness of 54.5° (ASKER-C). Letter symbol E denotes a power source for applying a voltage to this charging roller, which applies a given voltage to the mandrel 42*a* of the charging roller 42**. In FIG. 2, E indicates a system where an AC voltage is superimposed on a DC voltage. As for conditions, the above conditions were employed.

In the process cartridge, an elastic urethane rubber blade having the function as a charging member was used, which was set in a manner of pressing the developing sleeve.

The primary charging was at −700 V, a gap was provided so that the photosensitive drum is not brought into contact with the magnetic toner layer on the developing sleeve (internally provided with a magnet), and electrostatic images were developed while applying an AC bias (f: 1,800 Hz; Vpp: 1,400 V) and a DC bias ($V_{DC}$: −500 V) to the developing sleeve, under $V_L$ set at −170 V. Thus, magnetic toner images were formed on the OPC photosensitive drum.

The magnetic toner images thus formed were transferred to plain paper at the above plus transfer potential, and the plain paper having thereon the magnetic toner images was passed through a heat and pressure roller type fixing assembly to fix the magnetic toner images.

In this fixing, the surface temperature of the heat roller of the heat and pressure roller type fixing assembly was set at 180° C., the total pressure between the heat roller and the pressure roller at 5.5 kg, and a nip between them at 4 mm.

Under conditions set as above, a printing test was made on 20,000 sheets in an environment of normal temperature and normal humidity (25° C., 60% RH) at a printing speed of 20 sheets(A4)/minute while supplying the magnetic toner. Images obtained were evaluated in respect of the items shown below.

Similarly, image reproduction was tested in environments of high temperature and high humidity (32.5° C., 85% RH) and low temperature and low humidity (10° C., 15% RH). The printing mode was changed to 2 sheets/20 seconds.

In the environment of high temperature and high humidity, image reproduction was tested on 4,000 sheets, and thereafter image reproduction was further tested on 4,000 sheets after standing for two days in the same environment.

(1) Image density:

Evaluation was made on how the image density was maintained when printing on 10,000 sheets of plain paper (75 g/m$^2$) for usual copying machines was completed. The image density was measured using Macbeth Reflection Densitometer (manufactured by Macbeth Co.), as relative density with respect to an image printed on a white ground of an original with a density of 0.00.

(2) Fog:

Fog was calculated from a comparison between the whiteness of transfer paper as measured by a reflectometer (manufactured by Tokyo Denshoku K.K.) and the whiteness of transfer paper similarly measured after printing of solid white. This was made in the environment of low temperature and low humidity (15° C., 10% RH) and in a printing mode of 2 sheets/20 seconds.

Figure 3:
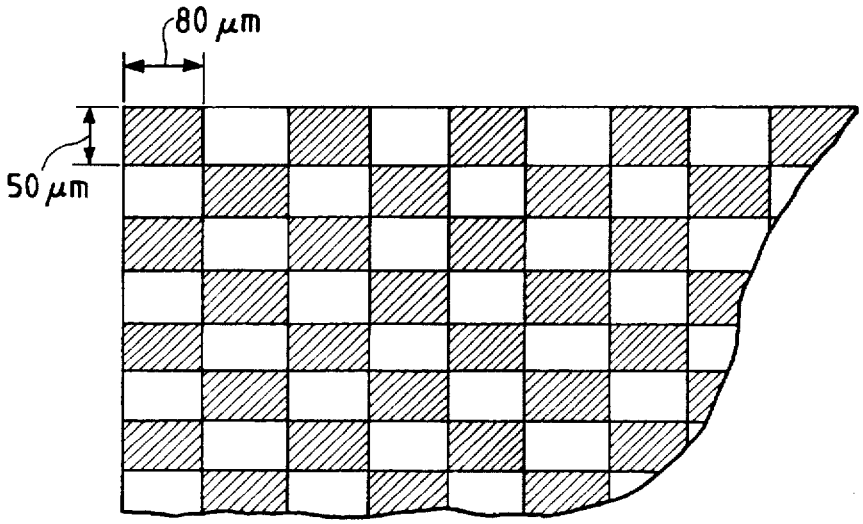
FIG. 3 illustrates a checker pattern used for testing developing performance of a magnetic toner.

(3) Image quality:

The pattern as shown in FIG. 3 was printed, and its dot reproducibility was evaluated according to the following ranks.

AA: Very good (2 or less defects/100 dots)
A: Good (3 to 5 defects/100 dots)
B: Average (6 to 10 defects/100 dots)
C: Poor (11 or more defects/100 dots)

(4): Fixing performance:

Fixing performance was evaluated as the rate of a decrease in image density before and after fixed images were rubbed with soft thin paper under application of a load of 50 g/cm$^2$. This was made in the environment of low temperature and low humidity (15° C., 10% RH).

AA: less than 5% (excellent)
A: 5% to less than 10% (good)
B: 10% to less than 20% (average)
C: 20% or more (poor)

(5) Anti-offset properties:

Anti-offset properties were evaluated on the degree of contamination occurring on images when sample images with an image area percentage of about 5% were printed.

AA: Very good (no occurrence)
A: Good (little occurrence)
B: Average (a little occurrence)
C: Poor (contamination greatly occurs on images)

Meanwhile, after the printing test was completed, the state of adhesion of residual toner on the surface of the developing sleeve and the effect thereof on printed images were visually evaluated.

AA: Very good (no occurrence)
A: Good (little occurrence)
B: Average (toner adhesion occurs but has little effect on images)
C: Poor (toner adhesion greatly occurs to cause uneven images)

Similarly, the occurrence of adhesion of residual toner on the surface of the photosensitive drum and the effect thereof on printed images were visually evaluated.

AA: Very good (no occurrence)
A: Good (scratches are. slightly seen but has no effect on images)
B: Average (toner adhesion occurs or scratches are seen but has or have little effect on images)
C: Poor (Toner adhesion greatly occurs to cause image faults like vertical lines)

Results of the evaluation are shown in Table 7.

TABLE 7

| | | | | Results of evaluation | | | | | | | | | | | | |
|---|---|---|---|---|---|---|---|---|---|---|---|---|---|---|---|---|
| | | | | Image density | | | | | | Fog | | | | | | |
| | Toner | Resin composition | Magnetic iron oxide | N/N initial stage | N/N running end stage | L/L running end stage | H/H initial stage | Left at H/H middle stage | H/H running end stage | (both sides) in L/L 4,000 sheets runing | (1) | (2) | (3) | (4) | (5) | (6) |
| Example: | | | | | | | | | | | | | | | | |
| 1 | A | I | a | 1.45 | 1.45 | 1.45 | 1.44 | 1.40 | 1.44 | 1.5% | AA | AA | AA | AA | AA | AA |
| 2 | B | II | a | 1.45 | 1.45 | 1.45 | 1.44 | 1.39 | 1.38 | 2.7% | A | A | AA | A | AA | AA |
| 3 | C | III | a | 1.44 | 1.43 | 1.44 | 1.44 | 1.40 | 1.43 | 2.4% | A | A | B | AA | AA | A |
| 4 | D | IV | a | 1.43 | 1.42 | 1.44 | 1.42 | 1.37 | 1.39 | 1.8% | A | A | A | A | A | A |
| 5 | E | V | a | 1.43 | 1.42 | 1.43 | 1.42 | 1.38 | 1.40 | 1.6% | AA | AA | A | A | A | A |
| 6 | F | VI | a | 1.42 | 1.40 | 1.42 | 1.40 | 1.35 | 1.38 | 2.5% | A | A | B | B | B | A |
| 7 | G | VII | a | 1.42 | 1.40 | 1.43 | 1.40 | 1.35 | 1.37 | 2.2% | A | AA | A | B | B | A |
| 8 | H | I | b | 1.45 | 1.45 | 1.45 | 1.42 | 1.38 | 1.40 | 1.5% | A | AA | AA | AA | AA | AA |
| 9 | I | I | c | 1.45 | 1.44 | 1.43 | 1.42 | 1.39 | 1.41 | 1.9% | A | AA | AA | AA | AA | AA |
| 10 | J | I | d | 1.45 | 1.45 | 1.45 | 1.44 | 1.41 | 1.44 | 1.4% | AA | AA | AA | AA | AA | AA |
| 11 | K | I | e | 1.45 | 1.44 | 1.44 | 1.43 | 1.41 | 1.43 | 1.5% | AA | AA | AA | AA | AA | AA |
| 12 | L | I | f | 1.45 | 1.44 | 1.44 | 1.43 | 1.39 | 1.41 | 1.7% | A | AA | AA | AA | AA | AA |
| 13 | M | I | g | 1.44 | 1.43 | 1.43 | 1.42 | 1.37 | 1.39 | 1.9% | A | AA | AA | AA | AA | AA |
| Example: | | | | | | | | | | | | | | | | |
| 14 | N | I | h | 1.44 | 1.43 | 1.44 | 1.43 | 1.32 | 1.35 | 1.5% | B | AA | AA | AA | AA | AA |
| 15 | O | I | i | 1.44 | 1.44 | 1.44 | 1.43 | 1.35 | 1.36 | 1.8% | B | AA | AA | AA | AA | AA |
| 16 | P | I | J | 1.44 | 1.43 | 1.44 | 1.43 | 1.35 | 1.36 | 1.6% | B | AA | AA | AA | AA | AA |
| 17 | Q | I | k | 1.44 | 1.43 | 1.44 | 1.44 | 1.36 | 1.38 | 1.7% | B | AA | AA | AA | AA | AA |
| 18 | R | I | l | 1.42 | 1.41 | 1.38 | 1.43 | 1.40 | 1.40 | 2.8% | A | AA | AA | AA | AA | AA |
| 19 | S | I | m | 1.44 | 1.43 | 1.44 | 1.41 | 1.30 | 1.33 | 1.6% | B | AA | AA | AA | AA | AA |
| 20 | A2 | I | a | 1.45 | 1.44 | 1.45 | 1.44 | 1.41 | 1.44 | 3.0% | A | A | AA | AA | AA | AA |
| Comparative Example: | | | | | | | | | | | | | | | | |
| 1 | T | i | l | 1.42 | 1.41 | 1.38 | 1.43 | 1.39 | 1.4 | 3.1% | A | B | A | A | AA | AA |
| 2 | U | ii | l | 1.41 | 1.40 | 1.38 | 1.40 | 1.35 | 1.31 | 3.5% | A | B | B | A | AA | A |
| 3 | V | iii | l | 1.42 | 1.41 | 1.38 | 1.29 | 1.22 | 1.22 | 3.1% | C | AA | AA | A | A | A |
| 4 | W | iv | l | 1.42 | 1.41 | 1.38 | 1.40 | 1.34 | 1.36 | 3.1% | B | A | AA | A | A | A |
| 5 | X | v | l | 1.40 | 1.38 | 1.37 | 1.37 | 1.32 | 1.35 | 4.0% | B | C | B | AA | AA | C |

N/N: Normal-temperature normal-humidity environment
L/L: Low-temperature low-humidity environment
H/H: High-temperature high-humidity environment
(1): Dot reproducibility in H/H;
(2): Fixing performance;
(3) Anti-offset
(4): Sleeve contamination;
(5): Drum contamination;
(6): Fixing roller contamination

RESIN COMPOSITION, PREPARATION EXAMPLES 8 TO 11

In the same manner as in Resin Composition Preparation Example 1 but changing the amount of monobutyl maleate, styrene, n-butyl acrylate each and the amount of the initiator, resin compositions VIII to XII as shown in Table 8 were obtained.

TABLE 8

Physical Properties of Resin Compositions

| Resin composition | Low-molecular weight polymer | | | | | Low/high molecular weight polymer ratio ($W_L/W_H$) | High-molecular weight polymer | | | | | | Molecular wt. ≧ $1 \times 10^6$ GPC area ratio (%) | THF-insoluble matter (%) |
|---|---|---|---|---|---|---|---|---|---|---|---|---|---|---|
| | | Mw | PMw | Tg (°C.) | $A'_{VL}$ (mgKOH/g) | | | Mw ($\times 10^4$) | PMw ($\times 10^4$) | Tg (°C.) | $A'_{VH}$ (mgKOH/g) | | | |
| VIII | L-2 | 5,000 | 3,700 | 64 | 26.3 | 50/50 | H-6 | 120 | 82 | 61.5 | 8 | | 11.5 | 3.0 |
| X | L-5 | 9,700 | 8,500 | 62 | 18 | 75/25 | H-1 | 180 | 120 | 62 | 6 | | 9.0 | 2.0 |
| XI | L-6 | 9,700 | 8,500 | 62 | 41.2 | 75/25 | H-1 | 180 | 120 | 62 | 6 | | 9.1 | 2.1 |
| XII | L-1 | 9,600 | 8,500 | 62 | 25 | 75/25 | H-7 | 180 | 125 | 61 | 12.4 | | 9.3 | 3.0 |

EXAMPLES 21 TO 24

Toners H to K were prepared in the same manner as in Example 1 except for using the resin compositions VIII to XI. Physical properties of Toners H to K obtained, and in addition thereto those of Toners A, C and E, are shown in Table 9.

TABLE 9

| | Resin composition | Amount of magnetic iron oxide (pbw) | GPC molecular weight distribution: Low-molecular side peak value LMp | Minimum value Min ($\times 10^4$) | High-molecular side peak value HMp ($\times 10^4$) | Molecular wt. ≧ $1 \times 10^6$ ratio (%) | THF-insoluble matter in polymer (wt. %) | Toner true density (g/cm$^3$) |
|---|---|---|---|---|---|---|---|---|
| Toner: | | | | | | | | |
| A | I | 100 | 8,100 | 6 | 67 | 5.1 | 0.9 | 1.74 |
| H | VIII | 70 | 3,600 | 4.5 | 41 | 3.6 | 0.6 | 1.57 |
| C | III | 80 | 26,000 | 9 | 68 | 3.0 | 0.4 | 1.63 |
| E | V | 100 | 8,100 | 5 | 42 | 2.0 | 0.3 | 1.74 |
| I | IX | 100 | 8,200 | 6 | 67 | 5.0 | 0.9 | 1.74 |
| J | X | 100 | 8,200 | 6 | 67 | 5.0 | 0.9 | 1.74 |
| K | XI | 100 | 8,100 | 6 | 69 | 5.2 | 1.1 | 1.74 |
| Comparative Toner: | | | | | | | | |
| X | v* | 100 | 32,000 | 12 | 73 | 2.0 | 0.7 | 1.74 |

*Comparative resin composition

Acid values of the resin compositions of Toners H to K are also shown in Table 10.

EXAMPLE 25

Using Toner A and using a modified machine of a laser beam printer LBP-A304GII of 8 sheets/minute, manufactured by Canon Inc., which was modified to a printing speed of 20 sheets/minute, image reproduction was tested to make evaluation. In this test, the processing speed was 110 mm/sec.

As the toner carrying member, a sleeve (center line average roughness Ra: 2.4) comprised of an aluminum

TABLE 10

Physical Properties of Toner Polymer Components

| | $A_{VL}$ (mgKOH/g) | $A_{VH}$ (mgKOH/g) | $A_{VL}-A_{VH}$ | $A_{VL} \times \frac{W_L}{W_L+W_H}$ | $A_{VH} \times \frac{W_H}{W_L+W_H}$ | $\frac{1}{W_L+W_H}(A_{VL}W_L+A_{VH}W_H)$ | Acid value/total acid value ratio |
|---|---|---|---|---|---|---|---|
| Toner: | | | | | | | |
| H | 21 | 9 | 12 | 10.5 | 4.5 | 15 | 0.57 |
| I | 16 | 7 | 9 | 12 | 1.75 | 13.75 | 0.82 |
| J | 40 | 7 | 33 | 30 | 1.75 | 31.75 | 0.39 |
| K | 23 | 13 | 10 | 17.25 | 3.25 | 20.5 | 0.61 |

substrate spray-coated with a resin with carbon black and graphite dispersed therein was used, and an elastic blade made of urethane was brought into touch with the sleeve at a linear pressure of 20 g/cm to control the toner layer thickness. The coat weight per unit area of the toner thin layer on the toner carrying member was set to be 2.1 g at the initial stage, where the w/ρ was 1.21 and the height of the toner layer was about 140 μm at the highest portion.

An OPC drum was used as the electrostatic latent image bearing member, and its peripheral speed was 110 mm/sec. The peripheral speed of the developing sleeve (the toner carrying member) installed to leave a gap of 300 μm from the OPC drum was set at 132 mm/sec, and its peripheral speed was 1.2 times as high as the OPC drum.

The photosensitive drum was primarily charged to $V_D$=−700 V, and its surface was scanned with laser light of microspots in accordance with an image pattern to form electrostatic latent images of $V_L$=−700 V. The electrostatic latent images on the OPC drum were developed while applying an AC bias of f=1,800 Hz and Vpp=1,400 V and a DC bias of $V_{DC}$=−500 V, between the developing sleeve having the toner carried thereon and the OPC drum. Thus, magnetic toner images were formed.

The magnetic toner images thus formed were transferred to transfer paper while applying plus charges from its back by means of a transfer assembly having a transfer roller having a conductive elastic layer with a surface rubber hardness of 27°, the roller being brought into contact with the OPC drum at a contact pressure of 50 g/cm$^2$. The transfer paper was further passed through a heat and pressure roller type fixing assembly to obtain fixed images.

In this fixing, the surface temperature of the heat roller of the heat and pressure roller type fixing assembly was set at 180° C., the total pressure between the heat roller and the pressure roller at 5.5 kg, and a nip at 4 mm.

Under conditions set as above, printing tests were made in an environment of low temperature and low humidity (15° C., 10% RH) and in an environment of high temperature and high humidity (32.5° C., 85% RH). The printing mode was set to 2 sheets/20 seconds.

In the environment of low temperature and low humidity, after initial images were sampled, images composed of nine (9) solid black images (three rows by three columns) of 5 mm square each were continuously printed on 100 sheets, and the images formed were used for the evaluation of fixing performance. Thereafter, a running test for 20,000 sheets was made while successively supplying the toner.

In the environment of high temperature and high humidity, images were reproduced on 5,000 sheets, and thereafter images were further reproduced on 5,000 sheets after standing for two days in the same environment.

Evaluation (1) Image density:

Images composed of nine (9) solid black images (three rows by three columns) of 5 mm square each were printed, and the image density was measured using Macbeth Reflection Densitometer (manufactured by Macbeth Co.), as relative density with respect to an image printed on a white ground of an original with a density of 0.00.

(2) Fog:

Using a reflectometer (manufactured by Tokyo Denshoku K.K.), the whiteness of transfer paper before printing was beforehand measured, and a value at a point where a difference between the whiteness of transfer paper before printing and the whiteness of solid white image printed in the environment of low temperature and low humidity was maximum, were recorded every 1,000 sheets.

(3) Fixing performance:

In the environment of low temperature and low humidity, after initial images were sampled, images composed of nine (9) solid black images (three rows by three columns) of 5 mm square each were continuously printed on 100 sheets. Using the samples thus obtained, fixed images were rubbed with soft thin paper under application of a load of 50 g/cm$^2$, and the fixing performance was evaluated in the following way as the worst values of the rate of decrease in image density before and after the rubbing.

AA: less than 5% (excellent)
A: 5% to less than 10% (good)
B: 10% to less than 20% (average)
C: 20% or more (poor)

(4) Anti-offset properties:

Anti-offset properties were evaluated in accordance with the degree of contamination occurring on images when sample images with an image area percentage of about 5% were printed.

AA: Excellent (no occurrence)
A: Good (only a very little occurrence)
B: Average (a little occurrence)
C: Poor (contamination greatly occurs on images)

(5) Sleeve contamination:

After the printing test was completed, the state of adhesion of residual toner on the surface of the developing sleeve and the effect thereof on printed images were visually evaluated.

AA: Very good (no occurrence)
A: Good (little occurrence)
B: Average (toner adhesion occurs but has little effect on images)
C: Poor (toner adhesion greatly occurs to cause uneven images)

(6) Drum contamination:

The occurrence of adhesion of residual toner on the surface of the photosensitive drum and the effect thereof on printed images were visually evaluated.

AA: Very good (no occurrence)
A: Good (scratches are slightly seen but has no effect on images)
B: Average (toner adhesion occurs or scratches are seen but has or have little effect on images)
C: Poor (toner adhesion greatly occurs to cause image fault like vertical lines)

Results of the evaluation are shown in Table 11.

EXAMPLES 26 TO 41

Tests and evaluation were made in the same manner as in Example 25 except that the w/ρ was changed by using sleeves with different center line average roughness Ra, and also the toner carrying member/latent image bearing member peripheral speed ratio and the toner were changed as shown in Table 11.

Results obtained are shown together in Table 11.

All of Examples 25 to 41 showed good results, i.e., superior fixing performance and anti-offset properties, superior density durability in every environment, and low level of fog.

Examples 37 to 41 showed overall a little inferior results compared with Example 25.

COMPARATIVE EXAMPLE 6

Tests and evaluation were made in the same manner as in Example 25 except that the w/ρ, the toner carrying member/ latent image bearing member peripheral speed ratio and the toner were changed as shown in Table 11.

The results obtained are shown in Table 11.

Comparative Example 6 showed poor fixing performance and also caused great contamination of fixing rollers.

What is claimed is:

1. A toner for developing electrostatic images, comprising a composition containing at least a polymer component (A) and a charge control agent, wherein;

said polymer component (A);

TABLE 11(A)

| | Toner | Resin composition | Sleeve Ra | W (mg/cm²) | ρ | w/ρ | Sleeve/drum peripheral speed ratio | Fixing performance | Anti-offset | Sleeve contamination | Drum contamination | Fixing roller contamination |
|---|---|---|---|---|---|---|---|---|---|---|---|---|
| Example: | | | | | | | | | | | | |
| 25 | A | I | 2.4 | 2.1 | 1.74 | 1.21 | 1.2 | AA | AA | AA | AA | AA |
| 26 | A | I | 1.1 | 1 | 1.74 | 0.57 | 1.2 | AA | AA | A | A | AA |
| 27 | A | I | 2.7 | 2.4 | 1.74 | 1.38 | 1.2 | AA | AA | AA | AA | AA |
| 28 | A | I | 2.4 | 2.1 | 1.74 | 1.21 | 1.1 | AA | AA | AA | AA | AA |
| 29 | A | I | 2.4 | 2.1 | 1.74 | 1.21 | 1.9 | AA | AA | A | A | AA |
| 30 | A | I | 2.4 | 2.1 | 1.74 | 1.21 | 1.5 | AA | AA | AA | AA | AA |
| 31 | H | VIII | 2.4 | 1.9 | 1.57 | 1.21 | 1.5 | A | AA | A | AA | AA |
| 32 | C | III | 2.4 | 2 | 1.63 | 1.23 | 1.5 | A | A | A | AA | A |
| 33 | E | V | 2.4 | 2.1 | 1.74 | 1.21 | 1.5 | AA | A | A | A | A |
| 34 | I | IX | 2.4 | 2.1 | 1.74 | 1.21 | 1.2 | A | A | A | AA | A |
| 35 | J | X | 2.4 | 2.1 | 1.74 | 1.21 | 1.2 | AA | A | A | A | A |
| 36 | K | XI | 2.4 | 2.1 | 1.74 | 1.21 | 1.2 | A | AA | A | A | A |
| 37 | A | I | 2.9 | 2.6 | 1.74 | 1.49 | 1.2 | AA | AA | AA | AA | AA |
| 38 | A | I | 0.7 | 0.8 | 1.74 | 0.46 | 1.2 | AA | AA | B | B | AA |
| 39 | A | I | 2.4 | 2.1 | 1.74 | 1.21 | 0.8 | AA | AA | AA | AA | AA |
| 40 | A | I | 2.4 | 2.1 | 1.74 | 1.21 | 2.2 | AA | AA | B | B | AA |
| 41 | H | VIII | 0.7 | 0.7 | 1.57 | 0.45 | 1.9 | A | AA | B | A | AA |
| Comparative Example: | | | | | | | | | | | | |
| 6 | x | (v) | 2.4 | 2.1 | 1.74 | 1.21 | 1.2 | C | B | AA | AA | C |

TABLE 11(B)

| | Image density | | | | | | | | | | |
|---|---|---|---|---|---|---|---|---|---|---|---|
| | Normal-temp. normal-humid. env. | | | | High-temperature high-humidity environment | | | | | | |
| | Initial stage | | After 20.000 sh. | | Initial stage | | After left at 5.000 sh. | | After 10,000 sh. | | |
| | 5 msq. solid | Solid | 5 msq. solid | Solid | 5 msq. solid | Solid | 5 msq. solid | Solid | 5 msq. solid | Solid | Fog (%) |
| Example: | | | | | | | | | | | |
| 25 | 1.46 | 1.44 | 1.46 | 1.44 | 1.45 | 1.40 | 1.40 | 1.32 | 1.42 | 1.40 | 2 |
| 26 | 1.47 | 1.45 | 1.41 | 1.36 | 1.46 | 1.43 | 1.42 | 1.33 | 1.42 | 1.38 | 1.1 |
| 27 | 1.40 | 1.38 | 1.45 | 1.44 | 1.40 | 1.39 | 1.35 | 1.31 | 1.42 | 1.41 | 2.5 |
| 28 | 1.46 | 1.43 | 1.45 | 1.42 | 1.45 | 1.39 | 1.40 | 1.29 | 1.42 | 1.39 | 2.3 |
| 29 | 1.47 | 1.46 | 1.40 | 1.39 | 1.45 | 1.43 | 1.43 | 1.37 | 1.37 | 1.35 | 1.3 |
| 30 | 1.47 | 1.45 | 1.43 | 1.42 | 1.45 | 1.42 | 1.41 | 1.36 | 1.44 | 1.43 | 1.6 |
| 31 | 1.45 | 1.42 | 1.46 | 1.45 | 1.45 | 1.41 | 1.41 | 1.36 | 1.40 | 1.38 | 2.5 |
| 32 | 1.44 | 1.42 | 1.46 | 1.45 | 1.45 | 1.42 | 1.38 | 1.34 | 1.43 | 1.41 | 2.2 |
| 33 | 1.45 | 1.42 | 1.43 | 1.41 | 1.43 | 1.39 | 1.40 | 1.37 | 1.42 | 1.40 | 1.7 |
| 34 | 1.43 | 1.39 | 1.45 | 1.42 | 1.42 | 1.38 | 1.36 | 1.31 | 1.39 | 1.34 | 2.2 |
| 35 | 1.44 | 1.41 | 1.46 | 1.43 | 1.42 | 1.39 | 1.32 | 1.28 | 1.37 | 1.33 | 2.4 |
| 36 | 1.42 | 1.38 | 1.43 | 1.41 | 1.39 | 1.36 | 1.34 | 1.30 | 1.40 | 1.38 | 2.1 |
| 37 | 1.38 | 1.35 | 1.45 | 1.44 | 1.37 | 1.32 | 1.35 | 1.28 | 1.42 | 1.40 | 3.6 |
| 38 | 1.47 | 1.45 | 1.36 | 1.29 | 1.46 | 1.43 | 1.33 | 1.10 | 1.29 | 1.09 | 1.8 |
| 39 | 1.40 | 1.33 | 1.42 | 1.33 | 1.35 | 1.20 | 1.18 | 1.00 | 1.42 | 1.35 | 2.4 |
| 40 | 1.47 | 1.47 | 1.36 | 1.35 | 1.45 | 1.44 | 1.37 | 1.33 | 1.31 | 1.26 | 1.1 |
| 41 | 1.45 | 1.42 | 1.41 | 1.36 | 1.45 | 1.43 | 1.39 | 1.34 | 1.37 | 1.32 | 1.3 |
| Comparative Example: | | | | | | | | | | | |
| 6 | 1.45 | 1.43 | 1.45 | 1.44 | 1.43 | 1.40 | 1.39 | 1.33 | 1.41 | 1.39 | 3.8 |

5 msq.: 5 mm square (solid black images)

a) contains substantially no tetrahydrofuran-insoluble matter;

b) in a chromatogram in gel permeation chromatography for tetrahydrofuran-soluble matter of said polymer component (A), has a main peak in the region of molecular weight of from 3,000 to 30,000 and a subpeak or a shoulder in the region of molecular weight of from 100,000 to 3,000,000; and c) has a low-molecular weight polymer component (L) corresponding to the region of molecular weight less than 50,000 in a chromatogram in gel permeation chromatography, having an acid value $A_{VL}$ of from 21 mg·KOH/g to 35 mg·KOH/g, and a high-molecular weight polymer component (H) corresponding to the region of molecular weight not less than 50,000 in the chromatogram in gel permeation chromatography, having an acid value $A_{VH}$ of from 0.5 mg·KOH/g to 11 g·KOH/g;

said acid values having a difference of $$10 \leqq (A_{VL}-A_{VH}) \leqq 27.$$

2. The toner according to claim 1, wherein said polymer component (A) has a value of acid value/total acid value, of 0.7 or less.

3. The toner according to claim 1, wherein the tetrahydrofuran-soluble matter of said polymer component (A) has a minimum value in the region of molecular weight of not less than 30,000 to less than 100,000 in its chromatogram of gel permeation chromatography.

4. The toner according to claim 1, wherein said composition has a glass transition temperature Tg of from 50° C. to 70° C., and $Tg_L$ of the low-molecular weight polymer component (L) and $Tg_H$ of the high-molecular weight polymer component (H) of said composition are in the relationship within the range of:

$$Tg_L \geqq Tg_H - 5.$$

5. The toner according to claim 4, wherein said composition has a glass transition temperature Tg of from 55° C. to 65° C., and $Tg_L$ of the low-molecular weight polymer component (L) and $Tg_H$ of the high-molecular weight polymer component (H) of said composition are in the relationship within the range of:

$$Tg_L \geqq Tg_H.$$

6. The toner according to claim 1, wherein said polymer component (A) satisfies the relationship of:

$$W_L:W_H = 50:50 \text{ to } 90:10$$

$$A_{VL} \times W_L/(W_L+W_H) \geqq A_{VH} \times W_H/(W_L+W_H) \times 4$$

$$11 \leqq (W_L+W_H)^{-1}(A_{VL}W_L+A_{VH}W_H) \leqq 30$$

wherein $W_L$ represents a content (% by weight) of the low-molecular weight polymer component (L); $W_H$ represents a content (% by weight) of the high-molecular weight polymer component (H); $A_{VL}$ represents an acid value (mg·KOH/g) of the low-molecular weight polymer component (L); and $A_{VH}$ represents an acid value (mg·KOH/g) of the high-molecular weight polymer component (H).

7. The toner according to claim 1, wherein said low-molecular weight polymer component (L) and said high-molecular weight polymer component (H) each contain at least a styrene monomer component unit in an amount not less than 65% by weight.

8. The toner according to claim 1, wherein said high-molecular weight polymer component (H) has a polymer polymerized using a polyfunctional polymerization initiator.

9. The toner according to claim 8, wherein said high-molecular weight polymer component (H) has a polymer polymerized using a polyfunctional polymerization initiator and a monofunctional polymerization initiator in combination.

10. The toner according to claim 1, wherein said composition contains magnetic iron oxide particles, and the magnetic iron oxide particles contain silicon element.

11. The toner according to claim 10, wherein said magnetic iron oxide particles have a silicon element content of from 0.1% by weight to 2.0% by weight based on the weight of iron element.

12. The toner according to claim 10 or 11, wherein said magnetic iron oxide particles have a silicon oxide on their surfaces in an amount of from 0.01% by weight to 1.00% by weight in terms of $SiO_2$.

13. The toner according to claim 10 or 11, wherein said magnetic iron oxide particles have been treated with an aluminum hydroxide used in an amount of from 0.01% by weight to 2.0% by weight in terms of aluminum element.

14. The toner according to claim 10, wherein said magnetic iron oxide particles have a smoothness of from 0.3 to 0.8.

15. The toner according to claim 10 or 14, wherein said magnetic iron oxide particles have a bulk density of 0.8 g/cm$^3$ or more.

16. The toner according to claim 10 or 14, wherein said magnetic iron oxide particles have a BET specific surface area of 15.0 m$^2$/g or less.

17. The toner according to claim 10 or 14, wherein said magnetic iron oxide particles have a total pore volume of from $7.0\times10^{-3}$ ml/g to $15.0\times10^{-3}$ ml/g.

18. The toner according to claim 1, wherein said charge control agent is a compound represented by the formula:

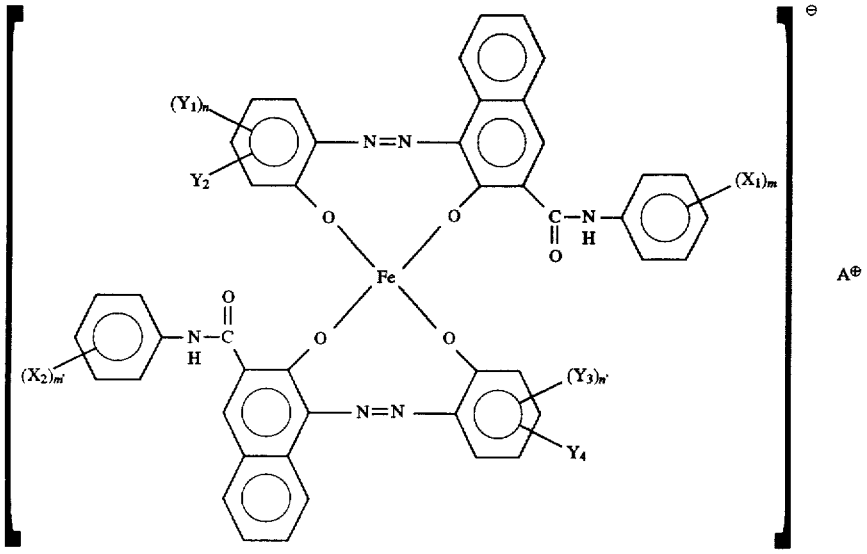

wherein $X_1$ and $X_2$ each represent a hydrogen atom, a lower alkyl group, a lower alkoxyl group, a nitro group or a halogen atom, and m and m' each represent an integer of 1 to 3; $Y_1$ and $Y_3$ each represent a hydrogen atom, an alkyl group having 1 to 18 carbon atoms, an alkenyl group having 2 to 18 carbon atoms, a sulfonamide group, a mesyl group, a sulfonic acid group, a carboxyester group, a hydroxyl group, an alkoxyl group having 1 to 18 carbon atoms, an acetylamino group, a benzoyl group, an amino group or a halogen atom, and n and n' each represent an integer of 1 to 3; $Y_2$ and $Y_4$ each represent a hydrogen atom or a nitro group; provided that the above $X_1$ and $X_2$, m and m', $Y_1$ and $Y_3$, n and n', and $Y_2$ and $Y_4$ may be the same or different; and $A^+$ represents $H^+$, $Na^+$, $K^+$, $NH_4^+$ or mixed ions thereof.

19. The toner according to claim 18, wherein said compound is a compound represented by the formula:

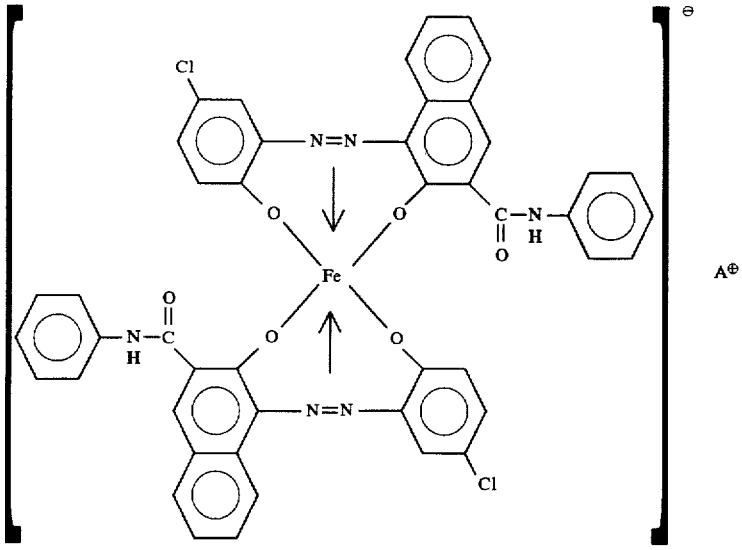

wherein $A^+$ represents $H^+$, $Na^+$, $K^+$, $NH_4^+$ or mixed ions thereof.

20. An image forming method comprising forming an electrostatic image on an electrostatic image bearing member, and developing the electrostatic image by the use of a toner held in a developing means to form a toner image, wherein;

said toner comprises a composition containing at least a polymer component (A) and a charge control agent, wherein;

said polymer component (A);

a) contains substantially no tetrahydrofuran-insoluble matter;

b) in a chromatogram in gel permeation chromatography for tetrahydrofuran-soluble matter of said polymer component (A), has a main peak in the region of molecular weight of from 3,000 to 30,000 and a subpeak or a shoulder in the region of molecular weight of from 100,000 to 3,000,000; and c) has a low-molecular weight polymer component (L) corresponding to the region of molecular weight less than 50,000 in a chromatogram in gel permeation chromatography, having an acid value $A_{VL}$ of from 21 mg·KOH/g to 35 mg·KOH/g, and a high-molecular weight polymer component (H) corresponding to the region of molecular weight not less than 50,000 in the chromatogram in gel permeation chromatography, having an acid value $A_{VH}$ of from 0.5 mg·KOH/g to 11 g·KOH/g;

said acid values having a difference of $$10 \leqq (A_{VL}-A_{VH}) \leqq 27.$$

21. The method according to claim 20, wherein a magnetic toner thin layer not coming into contact with said electrostatic image bearing member is formed on a toner carrying member provided to leave a given gap between the toner carrying member and the electrostatic image bearing member, and the electrostatic image on the electrostatic image bearing member is developed by the use of said toner while applying an alternating electric field across the toner carrying member and the electrostatic image bearing member, wherein;

said magnetic toner thin layer formed on the toner carrying member has a coat weight set to satisfy:

$$w/\rho = 0.5 \text{ to } 1.4$$

where w is a toner coat weight (mg) per 1 $cm^2$ of the surface of the toner carrying member, and ρ is a toner true density ($g/cm^3$); and the peripheral speed of the toner carrying member at the developing zone is 1.05 to 2.0 times the peripheral speed of the electrostatic image bearing member.

22. The method according to claim 20 or 21, wherein said polymer component (A) has a value of acid value/total acid value, of 0.7 or less.

23. The method according to claim 20 or 21, wherein the tetrahydrofuran-soluble matter of said polymer component (A) has a minimum value in the region of molecular weight of not less than 30,000 to less than 100,000 in its chromatogram in gel permeation chromatography.

24. The method according to claim 20 or 21, wherein said composition has a glass transition temperature Tg of from 50° C. to 70° C., and $Tg_L$ of the low-molecular weight polymer component (L) and $Tg_H$ of the high-molecular weight polymer component (H) of said composition are in the relationship within the range of:

$$Tg_L \geqq Tg_H - 5.$$

25. The method according to claim 20 or 21, wherein said composition has a glass transition temperature Tg of from 55° C. to 65° C., and $Tg_L$ of the low-molecular weight polymer component (L) and $Tg_H$ of the high-molecular weight polymer component (H) of said composition are in the relationship within the range of:

$$Tg_L \geqq Tg_H.$$

26. The method according to claim 20 or 21, wherein said electrostatic image bearing member is electrostatically charged with a contact charging means.

27. The method according to claim 26, wherein said contact charging means is a charging roller to which a voltage has been applied.

28. The method according to claim 26, wherein said contact charging means is a charging brush to which a voltage has been applied.

29. The method according to claim 26, wherein said contact charging means is a charging blade to which a voltage has been applied.

30. The method according to claim 26, wherein the toner image is transferred from the electrostatic image bearing member to a transfer medium.

31. The method according to claim 30, wherein the toner image is transferred from the electrostatic image bearing member to the transfer medium by a transfer means to which a voltage has been applied.

32. The method according to claim 31, wherein said transfer means is a transfer roller to which a voltage has been applied.

33. The method according to claim 31, wherein said transfer means is a transfer belt to which a voltage has been applied.

34. The method according to claim 30, wherein the toner image is fixed onto the transfer medium by a heat and pressure fixing means.

35. The method according to claim 30, wherein the toner image is transferred from the electrostatic image bearing member to an intermediate transfer medium and further transferred from the intermediate transfer medium to a transfer medium.

36. The method according to claim 35, wherein the toner image is fixed onto the transfer medium by a heat and pressure fixing means.

37. The method according to claim 20, wherein said polymer component (A) satisfies the relationship of:

$$W_L : W_H = 50:50 \text{ to } 90:10$$

$$A_{VL} \times W_L/(W_L+W_H) \geqq A_{VH} \times W_H/(W_L+W_H) \times 4$$

$$11 \leqq (W_L+W_H)^{-1}(A_{VL}W_L+A_{VH}W_H) \leqq 30$$

wherein $W_L$ represents a content (% by weight) of the low-molecular weight polymer component (L); $W_H$ represents a content (% by weight) of the high-molecular weight polymer component (H); $A_{VL}$ represents an acid value (mg·KOH/g) of the low-molecular weight polymer component (L); and $A_{VH}$ represents an acid value (mg·KOH/g) of the high-molecular weight polymer component (H).

38. The method according to claim 20, wherein said low-molecular weight polymer component (L) and said high-molecular weight polymer component (H) each contain at least a styrene monomer component unit in an amount not less than 65% by weight.

39. The method according to claim 20, wherein said high-molecular weight polymer component (H) has a polymer polymerized using a polyfunctional polymerization initiator.

40. The method according to claim 39, wherein said high-molecular weight polymer component (H) has a polymer polymerized using a polyfunctional polymerization initiator and a monofunctional polymerization initiator in combination.

41. The method according to claim 20, wherein said composition contains magnetic iron oxide particles, and the magnetic iron oxide particles contain silicon element.

42. The method according to claim 41, wherein said magnetic iron oxide particles have a silicon element content of from 0.1% by weight to 2.0% by weight based on the weight of iron element.

43. The method according to claim 41 or 42, wherein said magnetic iron oxide particles have a silicon oxide on their surfaces in an amount of from 0.01% by weight to 1.00% by weight in terms of $SiO_2$.

44. The method according to claim 41 or 45, wherein said magnetic iron oxide particles have been treated with an aluminum hydroxide used in an amount of from 0.01% by weight to 2.0% by weight in terms of aluminum element.

45. The method according to claim 41, wherein said magnetic iron oxide particles have a smoothness of from 0.3 to 0.8.

46. The method according to claim 41 or 42, wherein said magnetic iron oxide particles have a bulk density of 0.8 $g/cm^3$ or more.

47. The method according to claim 41 or 45, wherein said magnetic iron oxide particles have a BET specific surface area of 15.0 $m^2/g$ or less.

48. The method according to claim 41 or 45, wherein said magnetic iron oxide particles have a total pore volume of from $7.0\times10^{-3}$ ml/g to $15.0\times10^{-3}$ ml/g.

49. The method according to claim 20, wherein said charge control agent is a compound represented by the formula:

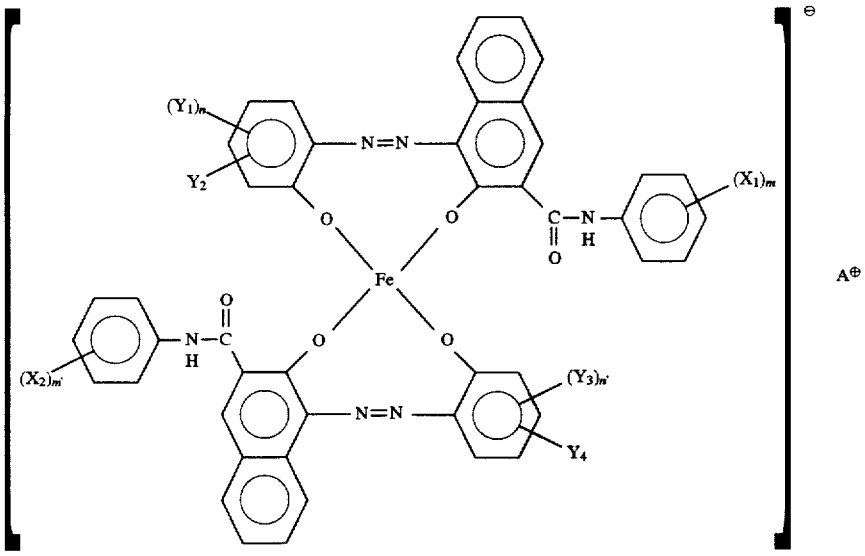

wherein $X_1$ and $X_2$ each represent a hydrogen atom, a lower alkyl group, a lower alkoxyl group, a nitro group or a halogen atom, and m and m' each represent an integer of 1 to 3; $Y_1$ and $Y_3$ each represent a hydrogen atom, an alkyl group having 1 to 18 carbon atoms, an alkenyl group having 2 to 18 carbon atoms, a sulfonamide group, a mesyl group, a sulfonic acid group, a carboxyester group, a hydroxyl group, an alkoxyl group having 1 to 18 carbon atoms, an acetylamino group, a benzoyl group, an amino group or a halogen atom, and n and n' each represent an integer of 1 to 3; $Y_2$ and $Y_4$ each represent a hydrogen atom or a nitro group; provided that the above $X_1$ and $X_2$, m and m', $Y_1$ and $Y_3$, n and n', and $Y_2$ and $Y_4$ may be the same or different; and $A^+$ represents $H^+$, $Na^+$, $K^+$, $NH_4^+$ or mixed ions thereof.

50. The method according to claim 49, wherein said compound is a compound represented by the formula:

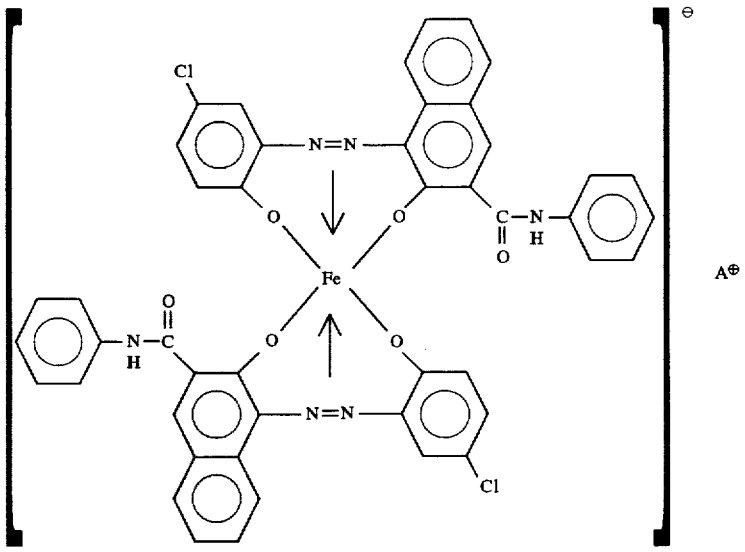

wherein $A^+$ represents $H^+$, $Na^+$, $K^+$, $NH_4^+$ or mixed ions thereof.

* * * * *

UNITED STATES PATENT AND TRADEMARK OFFICE

CERTIFICATE OF CORRECTION

PATENT NO. : 5,736,288

DATED : April 7, 1998

INVENTOR(S): TAKASHIGE KASUYA ET AL.

It is certified that error appears in the above-identified patent and that said Letters Patent is hereby corrected as shown below:

ON THE COVER PAGE AT [56] REFERENCES CITED, FOREIGN PATENT DOCUMENTS

"2-168264 6/1990 European Pat. Off.." should read
2-168264 6/1990 Japan.--

COLUMN 7

Line 25, "perform" should read --achieve--.

COLUMN 11

Line 51, "constitution" should read --constitution:--;
Line 57, "constitution" should read --constitution:--;
Line 60, "conditions" should read --conditions:--.

COLUMN 12

Line 66, "a-ethylacrylic" should read --α-ethylacrylic--.

COLUMN 13

Line 54, "be" should read --not be--;
Line 55, "not" should be deleted.

COLUMN 18

Line 11, "wax" should read --waxes--.

UNITED STATES PATENT AND TRADEMARK OFFICE

CERTIFICATE OF CORRECTION

PATENT NO. : 5,736,288

DATED : April 7, 1998

INVENTOR(S): TAKASHIGE KASUYA ET AL.

It is certified that error appears in the above-identified patent and that said Letters Patent is hereby corrected as shown below:

COLUMN 29

Line 16, "an mount" should read --an amount--.

COLUMN 32

Line 53, "6n" should read --on--;
Line 59, "at la" should read --at a--.

COLUMN 37

Line 58, "so oh" should read --so forth--.

COLUMN 38

Line 16, "were" should read --was--.

COLUMN 39

Table 2, "ratio (%) 9.2" should read --ratio (%) 9.0--;
Line 49, "mailer)" should read --maller--;
Line 57, "but" should read --by--;
Line 65, "but" should read --by--;

UNITED STATES PATENT AND TRADEMARK OFFICE

CERTIFICATE OF CORRECTION

PATENT NO. : 5,736,288

DATED : April 7, 1998

INVENTOR(S): TAKASHIGE KASUYA ET AL.

It is certified that error appears in the above-identified patent and that said Letters Patent is hereby corrected as shown below:

COLUMN 40

Line 35, "but" should read --by--;
Line 47, "but" should read --by--;
Line 62, "but" should read --by--.

COLUMN 42

Line 59, "Classifier" should read --classifier--.

COLUMN 43

Line 25, "but" should read --by--;
Table 6," "$W_L/W_L^{A_{VL}} + W_H^{X}$ " should read --$W_H/W_L^{A_{VL}} + W_H^{X}$ --.

COLUMN 44

Line 57, "but" should read --by--.

COLUMN 45

Line 9, "but" should read --by--.

COLUMN 48

Line 6, "are." should read --are--.

UNITED STATES PATENT AND TRADEMARK OFFICE

CERTIFICATE OF CORRECTION

PATENT NO. : 5,736,288

DATED : April 7, 1998

INVENTOR(S): TAKASHIGE KASUYA ET AL.

It is certified that error appears in the above-identified patent and that said Letters Patent is hereby corrected as shown below:

COLUMN 55

Line 18, "11 g·KOH/g;" should read --11 mg·KOH/g;--.

COLUMN 59

Line 4, "11 g·KOH/g;" should read --11 mg·KOH/g;--.

COLUMN 60

Line 58, "41 or 45," should read --41 or 42--;
Line 65, "41 or 42," should read --41 or 45--.

Signed and Sealed this

Eighth Day of June, 1999

*Attest:*

Q. TODD DICKINSON

*Attesting Officer*

*Acting Commissioner of Patents and Trademarks*